US010446348B2

(12) United States Patent
Tashima et al.

(10) Patent No.: US 10,446,348 B2
(45) Date of Patent: Oct. 15, 2019

(54) ELECTROMAGNETIC CONTACTOR

(71) Applicant: FUJI ELECTRIC FA COMPONENTS & SYSTEMS CO., LTD., Tokyo (JP)

(72) Inventors: Yuki Tashima, Kitamoto (JP); Kouetsu Takaya, Kounosu (JP); Hideo Adachi, Fukaya (JP); Yasuhiro Naka, Kitamoto (JP); Yuya Sakurai, Kounosu (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 73 days.

(21) Appl. No.: 15/878,014

(22) Filed: Jan. 23, 2018

(65) Prior Publication Data

US 2018/0158635 A1 Jun. 7, 2018

Related U.S. Application Data

(63) Continuation of application No. PCT/JP2017/003185, filed on Jan. 30, 2017.

(30) Foreign Application Priority Data

Feb. 25, 2016 (JP) ..... 2016-034744

(51) Int. Cl.
*H01H 9/02* (2006.01)
*H01H 50/02* (2006.01)
(Continued)

(52) U.S. Cl.
CPC ..... *H01H 50/023* (2013.01); *H01H 50/20* (2013.01); *H01H 50/36* (2013.01); *H01H 50/541* (2013.01)

(58) Field of Classification Search
CPC ..... H01H 50/541; H01H 50/56; H01H 50/20; H01H 50/36; H01H 50/29; H01H 50/14;
(Continued)

(56) References Cited

U.S. PATENT DOCUMENTS 2,783,340 A 2/1957 Davies et al.
3,942,143 A 3/1976 Pollmann et al.
(Continued)

FOREIGN PATENT DOCUMENTS

JP S56-167450 U 12/1981
JP 564-14832 A 1/1989
(Continued)

OTHER PUBLICATIONS

PCT International Search Report (PCT/ISA/210), PCT/JP2017/0031885 dated May 16, 2017.
(Continued)

*Primary Examiner* — Shawki S Ismail
*Assistant Examiner* — Lisa N Homza
(74) *Attorney, Agent, or Firm* — Manabu Kanesaka

(57) ABSTRACT

There is provided an electromagnetic contactor that ensures appropriately preventing a foreign matter from invading an auxiliary contact mechanism housing chamber from a main contact mechanism housing chamber via a through-hole on a partition wall; and a foreign matter from invading the main contact mechanism housing chamber from the auxiliary contact mechanism housing chamber via the through-hole on the partition wall. With an electromagnetic contactor (1), a main contact mechanism housing chamber (A) and an auxiliary contact mechanism housing chamber (B) are partitioned by a partition wall (10). The partition wall (10) has a through-hole (10*a*) through which a coupling shaft (34) is
(Continued)

inserted. A foreign matter invasion prevention mechanism (60) is provided at a peripheral area of the through-hole (10*a*).

17 Claims, 11 Drawing Sheets

(51) Int. Cl.
*H01H 50/20* (2006.01)
*H01H 50/36* (2006.01)
*H01H 50/54* (2006.01)

(58) Field of Classification Search
CPC .. H01H 50/546; H01H 50/023; H01H 47/002; H01H 2235/01; H01H 2050/028
USPC ..... 335/202
See application file for complete search history.

(56) References Cited

U.S. PATENT DOCUMENTS

| | | | | |
|---|---|---|---|---|
| 7,944,333 | B2 | 5/2011 | Swartzentruber et al. | |
| D826,869 | S * | 8/2018 | Sakurai | D13/159 |
| 2011/0114602 | A1 | 5/2011 | Bush et al. | |
| 2015/0022292 | A1* | 1/2015 | Tachikawa | H01H 50/54 335/131 |
| 2015/0048908 | A1* | 2/2015 | Isozaki | H01H 1/54 335/6 |
| 2016/0300676 | A1 | 10/2016 | Sakai et al. | |
| 2017/0358413 | A1* | 12/2017 | Tashima | H01H 50/20 |
| 2018/0144893 | A1* | 5/2018 | Konishi | H01H 50/04 |
| 2018/0144894 | A1* | 5/2018 | Takaya | H01H 50/36 |
| 2018/0158634 | A1* | 6/2018 | Takaya | H01H 47/22 |
| 2018/0158635 | A1* | 6/2018 | Tashima | H01H 50/02 |
| 2018/0197707 | A1* | 7/2018 | Takaya | H01H 50/02 |
| 2018/0269017 | A1* | 9/2018 | Konishi | H01H 51/29 |
| 2019/0066956 | A1* | 2/2019 | Konishi | H01H 1/06 |

FOREIGN PATENT DOCUMENTS

| | | | |
|---|---|---|---|
| JP | 2010-045044 | A | 2/2010 |
| JP | 2013-232340 | A | 11/2013 |
| JP | 2016-201286 | A | 12/2016 |

OTHER PUBLICATIONS

PCT/IB/373, "International Preliminary Report on Patentability for International Application No. PCT/JP2017/003185," dated Aug. 28, 2018.

PCT/ISA/237, "Written Opinion of the International Searching Authority for International Application No. PCT/JP2017/003185," May 16, 2017.

PCT/IB/338, "Notification of Transmittla of Translation of the International Preliminary Report on Patentability or International Application No. PCT/JP2017/003185," dated Sep. 7, 2018.

Europe Patent Office, "Search Report for European Patent Application No. 17756097.6," dated Jul. 19, 2019.

* cited by examiner

ELECTROMAGNETIC CONTACTOR

CROSS-REFERENCE TO RELATED APPLICATION

This is a continuation application of PCT International Application No. PCT/JP2017/003185 filed on Jan. 30, 2017, which claims a priority of Japanese Patent Application No. 2016-034744 filed on Feb. 25, 2016, the disclosure of which is incorporated herein.

TECHNICAL FIELD

The present invention relates to an electromagnetic contactor configured to open and close a current path.

BACKGROUND ART

Some electromagnetic contactors configured to open and close a current path include a main contact mechanism, which turns on and cuts off a high current, and an auxiliary contact mechanism, which coordinates with a behavior of the main contact mechanism. For example, an electromagnetic contactor including these main contact mechanism and auxiliary contact mechanism as described in PLT 1 has been conventionally known.

The electromagnetic contactor described in PLT 1 includes a pair of main-contact-side fixed contacts, a main contact mechanism including a main-contact-side movable contact, which is contactable to/separable from these pair of main-contact-side fixed contacts, an auxiliary contact mechanism, which coordinates with the main-contact-side movable contact, and an electromagnet unit, which drives the main-contact-side movable contact in the main contact mechanism. The electromagnet unit includes a movable plunger, which is coupled to the main-contact-side movable contact with a coupling shaft, and an excitation coil, which generates an exciting force at the electromagnet unit through excitation to drive the movable plunger.

A housing chamber airtightly seals the main contact mechanism, the auxiliary contact mechanism, and the movable plunger and the coupling shaft of the electromagnet unit as movable portions. The housing chamber internally seals gas for arc extinction for efficient extinction of the arc.

CITATION LIST

Patent Literature

PTL 1: U.S. Pat. No. 7,944,333

SUMMARY OF INVENTION

Technical Problem

The electromagnetic contactor including the main contact mechanism and the auxiliary contact mechanism as described in PLT 1 possibly includes a partition wall between the main contact mechanism and the auxiliary contact mechanism in the airtightly sealed housing chamber to cut off the arc generated at the main contact.

However, a through-hole or a similar member to cause the above-described coupling shaft or a similar member to pass through is provided on the partition wall between the main contact mechanism and the auxiliary contact mechanism; therefore, a main contact mechanism housing chamber and an auxiliary contact mechanism housing chamber cannot be completely partitioned. In view of this, an invasion of a foreign matter inside the main contact mechanism housing chamber into the auxiliary contact mechanism housing chamber passing through the through-hole on the partition wall or conversely, an invasion of a foreign matter inside the auxiliary contact mechanism housing chamber into the main contact mechanism housing chamber passing through the through-hole on the partition wall cannot be appropriately prevented.

Especially, this causes a problem that the foreign matter (such as shavings generated by sliding) generated in the main contact mechanism invades the inside of the auxiliary contact mechanism housing chamber and the foreign matter attaches to an auxiliary contact portion, resulting in a conduction failure.

Therefore, the present invention has been made to solve the above-described problems. The object of the present invention is to provide an electromagnetic contactor that can appropriately prevent a foreign matter from invading an auxiliary contact mechanism housing chamber from a main contact mechanism housing chamber via a through-hole on a partition wall; and a foreign matter from invading the main contact mechanism housing chamber from the auxiliary contact mechanism housing chamber via the through-hole on the partition wall.

Solution to Problem

To achieve the object, the gist of an electromagnetic contactor according to one aspect of the present invention includes a main contact mechanism housing chamber, an auxiliary contact mechanism housing chamber, and an electromagnet unit. The main contact mechanism housing chamber houses a main contact mechanism including a pair of main-contact-side fixed contacts and a main-contact-side movable contact. The main-contact-side movable contact is contactable to/separable from the pair of main-contact-side fixed contacts. The auxiliary contact mechanism housing chamber houses an auxiliary contact mechanism including a plurality of pairs of auxiliary-contact-side fixed contacts, a plurality of auxiliary-contact-side movable contacts, and an auxiliary movable contact support member. The plurality of auxiliary-contact-side movable contacts are contactable to/separable from the plurality of pairs of auxiliary-contact-side fixed contacts. The auxiliary movable contact support member supports the auxiliary-contact-side movable contacts. The electromagnet unit includes a movable plunger and a magnetic yoke. The movable plunger is coupled to the main-contact-side movable contact and the auxiliary movable contact support member via a coupling shaft. The magnetic yoke houses the movable plunger. The main contact mechanism housing chamber and the auxiliary contact mechanism housing chamber are partitioned by a partition wall. The partition wall has a through-hole through which the coupling shaft is inserted. A foreign matter invasion prevention mechanism is provided at a peripheral area of the through-hole.

Advantageous Effects of Invention

An electromagnetic contactor according to the present invention can appropriately prevent a foreign matter from invading an auxiliary contact mechanism housing chamber from a main contact mechanism housing chamber via a through-hole on a partition wall; and a foreign matter from invading the main contact mechanism housing chamber from the auxiliary contact mechanism housing chamber via the through-hole on the partition wall.

BRIEF DESCRIPTION OF DRAWINGS

FIG. 3A is a cross-sectional view illustrating a state of open main contact mechanism and auxiliary contact mechanism, and FIG. 3B is a cross-sectional view illustrating a state of the close main contact mechanism and auxiliary contact mechanism;

DESCRIPTION OF EMBODIMENTS

Figure 1:
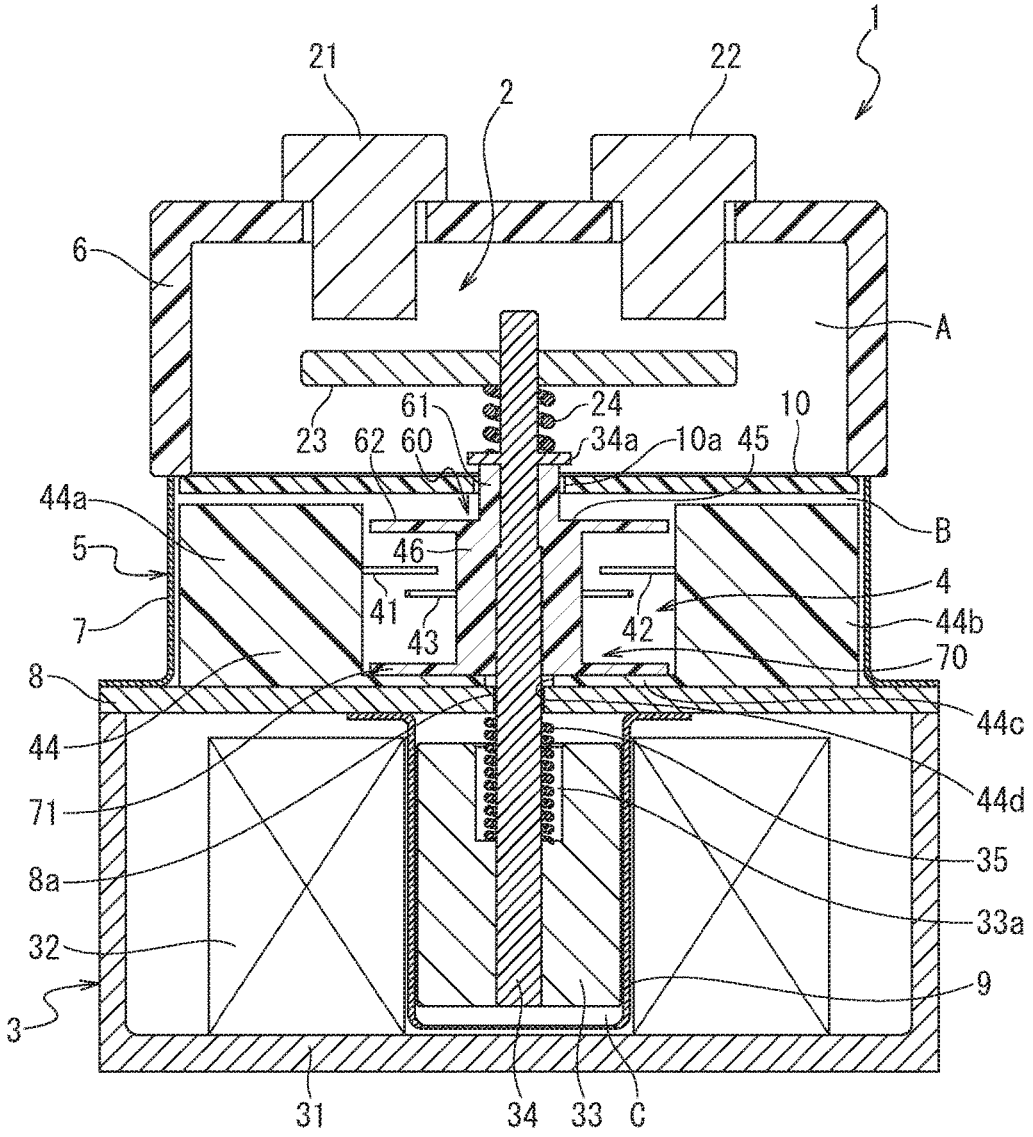
FIG. 1 is a cross-sectional view illustrating an electromagnetic contactor according to a first embodiment of the present invention.

The following describes embodiments of the present invention with reference to the drawings.

(First Embodiment)

FIG. 1 to FIGS. 3A and 3B illustrate an electromagnetic contactor according to the first embodiment of the present invention. An electromagnetic contactor 1 illustrated in FIG. 1 opens and closes a current path. The electromagnetic contactor 1 includes a main contact mechanism 2, an electromagnet unit 3, which drives a main-contact-side movable contact 23 (described later) in the main contact mechanism 2, an auxiliary contact mechanism 4, which coordinates with the main-contact-side movable contact 23, and a housing chamber 5.

The main contact mechanism 2 is located in a square tube 6 made of a ceramic constituting the housing chamber 5. The square tube 6 is obstructed with a top plate on the top side and is open on the lower side. The lower end of the square tube 6 is airtightly joined to a metallic joining member 7 constituting the housing chamber 5, and the lower end of the joining member 7 is joined to a top surface of an upper magnetic yoke 8, which will be described later, with a seal. An insulating partition wall 10 is disposed between the main contact mechanism 2 and the auxiliary contact mechanism 4 and at the lower end surface of the square tube 6. A main contact mechanism housing chamber A is formed on the upper side partitioned by the partition wall 10, and an auxiliary contact mechanism housing chamber B is formed on the lower side. The partition wall 10 is installed to mainly for the purpose of cutting off arc generated in the main contact mechanism 2.

The main contact mechanism 2 includes a pair of main-contact-side fixed contacts 21 and 22, which are housed in the main contact mechanism housing chamber A and fixed to the top plate of the square tube 6, and the main-contact-side movable contact 23, which is located connectable to/separable form the pair of main-contact-side fixed contacts 21 and 22. The main-contact-side fixed contacts 21 and 22 are made of a conductive metallic material and fixed to the top plate of the square tube 6 separated in a predetermined interval in a right-left direction in FIG. 1.

The main-contact-side movable contact 23 is made of a conductive metal and is a conductive plate long in the right-left direction in FIG. 1. The main-contact-side movable contact 23 is supported to a coupling shaft 34, which is fixed to a movable plunger 33 described later in the electromagnet unit 3, to be vertically movable. A flange 34*a* is formed so as to project outward at the lower side with respect to the main-contact-side movable contact 23 of the coupling shaft 34 and a part positioned in the main contact mechanism housing chamber A. Between the flange 34*a* and the main-contact-side movable contact 23, a contact spring 24 to urge the main-contact-side movable contact 23 upward is disposed.

The coupling shaft 34 is inserted through a through-hole 10*a* formed at the center of the partition wall 10, an auxiliary movable contact support member 45 described later is fixed to an approximately center of the coupling shaft 34 in the vertical direction, and the coupling shaft 34 is coupled to the movable plunger 33 at the lower end.

In a release state, contact portions formed on both ends of the main-contact-side movable contact 23 are separate from respective contact portions of the pair of main-contact-side fixed contacts 21 and 22 with a predetermined interval downward. In an input state, the main-contact-side movable contact 23 moves upward and the contact portions formed on both ends contact the respective contact portions of the pair of main-contact-side fixed contacts 21 and 22 by a predetermined contact force from the contact spring 24.

The auxiliary contact mechanism 4 includes a plurality of pairs of (two pairs in this embodiment) auxiliary-contact-side fixed contacts 41 and 42 and a plurality of (two in this embodiment) auxiliary-contact-side movable contacts 43, which are contactable to/separable from the plurality of pairs of the auxiliary-contact-side fixed contacts 41 and 42 housed in the auxiliary contact mechanism housing chamber B. This auxiliary contact mechanism 4 is used to, for example, detect the open/close state of the main contact mechanism 2 and detect a welding state of the main-contact-side movable contact 23 to the main-contact-side fixed contacts 21 and 22 in the main contact mechanism 2.

Figure 2:
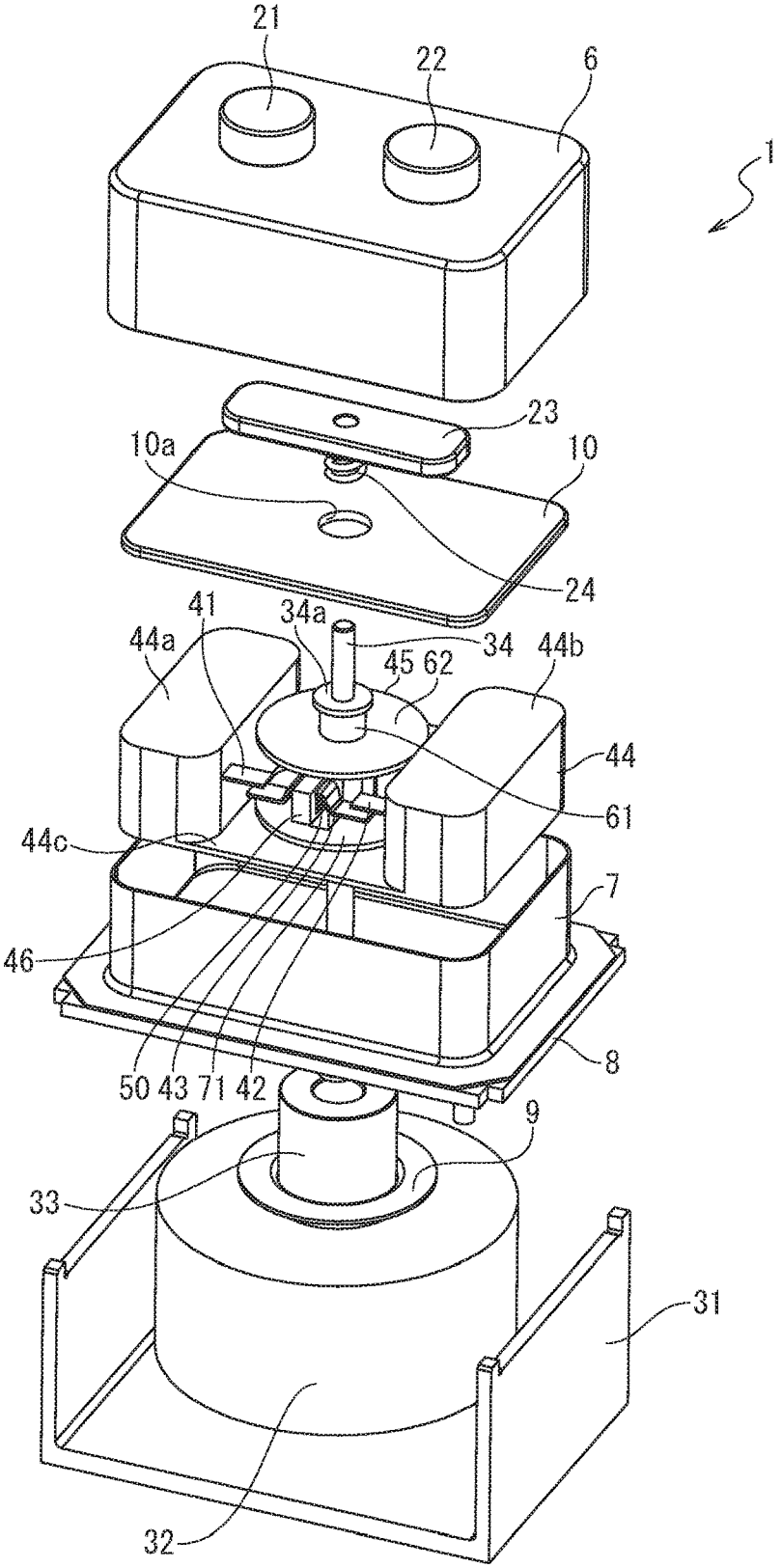
FIG. 2 is an exploded perspective view of the electromagnetic contactor illustrated in FIG. 1.

Here, the plurality of pairs of the auxiliary-contact-side fixed contacts 41 and 42 are fixed to an insulating auxiliary fixed contact support member 44. As illustrated in FIGS. 1 and 2, this auxiliary fixed contact support member 44 includes a one-side fixing portion 44*a* and an other-side fixing portion 44*b*. The one-side fixing portion 44*a* fixes the plurality of auxiliary-contact-side fixed contacts 41 at the one side separating at a predetermined interval in the front-rear direction (a direction perpendicular to the paper of FIG. 1). The other-side fixing portion 44*b* is located at a predetermined interval rightward with respect to the one-side fixing portion 44*a* and fixes the plurality of auxiliary-contact-side fixed contacts 42 at the other side separating at a predetermined interval in the front-rear direction. These lower end of the one-side fixing portion 44*a* and lower end of the other-side fixing portion 44*b* are coupled with a coupling plate 44*c*. The auxiliary fixed contact support member 44 is integrally formed by molding an insulating synthetic resin. The lower surface of the one-side fixing portion 44*a*, the lower surface of the other-side fixing portion 44*b*, and the lower surface of the coupling plate 44*c* are formed flush. The auxiliary fixed contact support member 44 is placed on the upper magnetic yoke 8 such that the lower surface of the one-side fixing portion 44*a*, the lower surface of the other-side fixing portion 44*b*, and the lower surface of the coupling plate 44*c* go along the top surface of the upper magnetic yoke 8. A through-hole 44*d* through which the coupling shaft 34 is inserted is formed at the center of the coupling plate 44*c*. The coupling plate 44*c* constitutes an electromagnet-unit-side partition wall.

As illustrated in FIGS. 1 and 2, the plurality of auxiliary-contact-side movable contacts 43 are supported to the auxiliary movable contact support member 45, which is fixed to the coupling shaft 34 between the main-contact-side movable contact 23 and the movable plunger 33, to be vertically movable. As illustrated in FIG. 2, the auxiliary movable contact support member 45 includes an auxiliary movable contact support 46, which extends in the front-rear direction (the direction perpendicular to the paper) and is formed into an approximately square shape. The respective auxiliary-contact-side movable contacts 43 are supported by the auxiliary movable contact support 46 in a state always urged upward by an urging spring 50.

Here, the respective pairs of auxiliary-contact-side fixed contacts 41 and 42 and the respective auxiliary-contact-side movable contacts 43 constitute a-contacts (normally open contacts). In the release state of the main-contact-side movable contact 23, contact portions formed on both ends of the auxiliary-contact-side movable contacts 43 are separate from respective contact portions of the pair of auxiliary-contact-side fixed contacts 41 and 42 with a predetermined interval downward. In the input state of the main-contact-side movable contact 23, the auxiliary-contact-side movable contacts 43 move upward and the contact portions formed on both ends contact the respective contact portions of the pair of the auxiliary-contact-side fixed contacts 41 and 42 by a predetermined contact force from the urging spring 50.

The respective pairs of auxiliary-contact-side fixed contacts 41 and 42 and auxiliary-contact-side movable contacts 43 may be configured as b-contacts (normally closed contacts). The auxiliary-contact-side fixed contacts 41 and 42 and the auxiliary-contact-side movable contact 43 at the one side may be configured as the a-contacts and the auxiliary-contact-side fixed contacts 41 and 42 and the auxiliary-contact-side movable contact 43 at the other side may be configured as the b-contacts.

Next, the electromagnet unit 3 includes the movable plunger 33 and an excitation coil 32, which drives the movable plunger 33. The movable plunger 33 is fixed to the lower end of the coupling shaft 34 and moves the main-contact-side movable contact 23 and the auxiliary-contact-side movable contacts 43 upward through excitation.

As illustrated in FIGS. 1 and 2, the electromagnet unit 3 includes a lower magnetic yoke 31 having a U shape viewed from the side surface. The plate-shaped upper magnetic yoke 8 is fixed to the upper end, which becomes the open end of the lower magnetic yoke 31, and the lower end of the above-described joining member 7 is joined to the top surface of this upper magnetic yoke 8 with a seal. A through-hole 8*a* is formed at the center of the upper magnetic yoke 8. The lower magnetic yoke 31 and the upper magnetic yoke 8 constitute a magnetic yoke to house the movable plunger 33.

A cap 9 in a shape of a cylinder with a closed bottom is joined to the center of the lower surface of the upper magnetic yoke 8 with a seal so as to surround the through-hole 8*a*. The cap 9 forms a movable plunger housing chamber C, which is partitioned from the auxiliary contact mechanism housing chamber B by the plate-shaped upper magnetic yoke 8. This movable plunger housing chamber C internally houses the movable plunger 33 where the coupling shaft 34 is inserted through the through-hole 8*a* and the through-hole 44*d* on the coupling plate 44*c*. Therefore, the square tube 6, the joining member 7, the upper magnetic yoke 8, and the cap 9 constitute the housing chamber 5 to airtightly seal the main contact mechanism 2, the auxiliary contact mechanism 4, the coupling shaft 34, and the movable plunger 33. The housing chamber 5 internally seals gas for extinction of arc.

The movable plunger 33 has a returned spring housing depressed portion 33*a* depressing downward from the top end surface. A return spring 35 that causes the movable plunger 33 to urge downward between the return spring 35 and the lower surface of the upper magnetic yoke 8 is disposed at the returned spring housing depressed portion 33*a*.

The excitation coil 32 is located on the bottom plate of the lower magnetic yoke 31 and at the peripheral area of the cap 9.

In the electromagnetic contactor 1 thus configured, a foreign matter is possibly generated in the main contact mechanism 2 in association with the opening behavior and the closing behavior of the main-contact-side movable contact 23 in the main contact mechanism 2. For example, generation of an arc generates metal powders, and shavings are generated when the main-contact-side movable contact 23 slides to the coupling shaft 34. This foreign matter possibly passes through the through-hole 10*a* on the partition wall 10 from the inside of the main contact mechanism housing chamber A and invades the inside of the auxiliary contact mechanism housing chamber B. Conversely, the foreign matter possibly passes through the through-hole 10*a* on the partition wall 10 from the inside of the auxiliary contact mechanism housing chamber B and invades the inside of the main contact mechanism housing chamber A. With the case of an insulating foreign matter, an attachment of the foreign matter to the contact portion of the auxiliary contact mechanism 4 and the contact portion of the main contact mechanism 2 results in poor conduction.

Further, the foreign matter inside the auxiliary contact mechanism housing chamber B possibly passes through the through-hole 44*d* on the coupling plate (the electromagnet-unit-side partition wall) 44*c* and the through-hole 8*a* on the upper magnetic yoke 8 from the inside of the auxiliary contact mechanism housing chamber B and invades the inside of the movable plunger housing chamber C. Conversely, the foreign matter inside the movable plunger housing chamber C possibly passes through the through-hole 8*a* on the upper magnetic yoke 8 and the through-hole 44*d* on the coupling plate 44*c* and invades the inside of the auxiliary contact mechanism housing chamber B. With the case of a foreign matter made of a metal material, an attachment of the foreign matter to an armature surface of the movable plunger 33 results in a behavior failure.

In view of this, a foreign matter invasion prevention mechanism 60 is disposed at the peripheral area of the through-hole 10*a* on the partition wall 10.

An electromagnet-unit-side foreign matter invasion prevention mechanism 70 is disposed at the peripheral area of the through-hole 44*d* on the coupling plate (the electromagnet-unit-side partition wall) 44*c*.

Figure 3A:
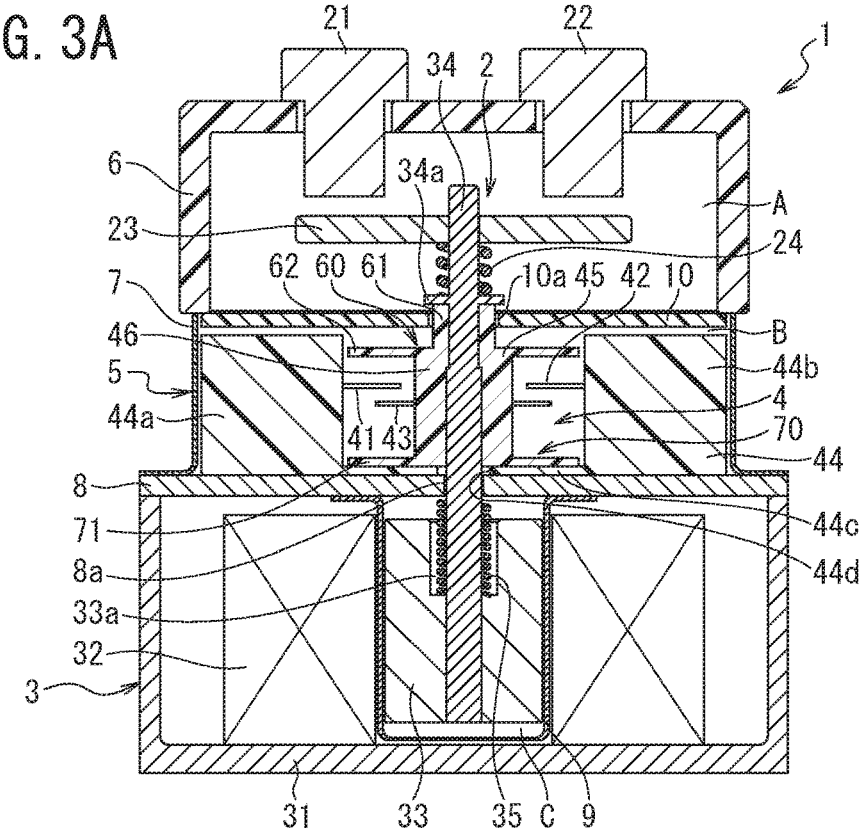
FIGS. 3A and 3B describe behaviors of the electromagnetic contactor illustrated in FIG. 1.
Figure 3B:
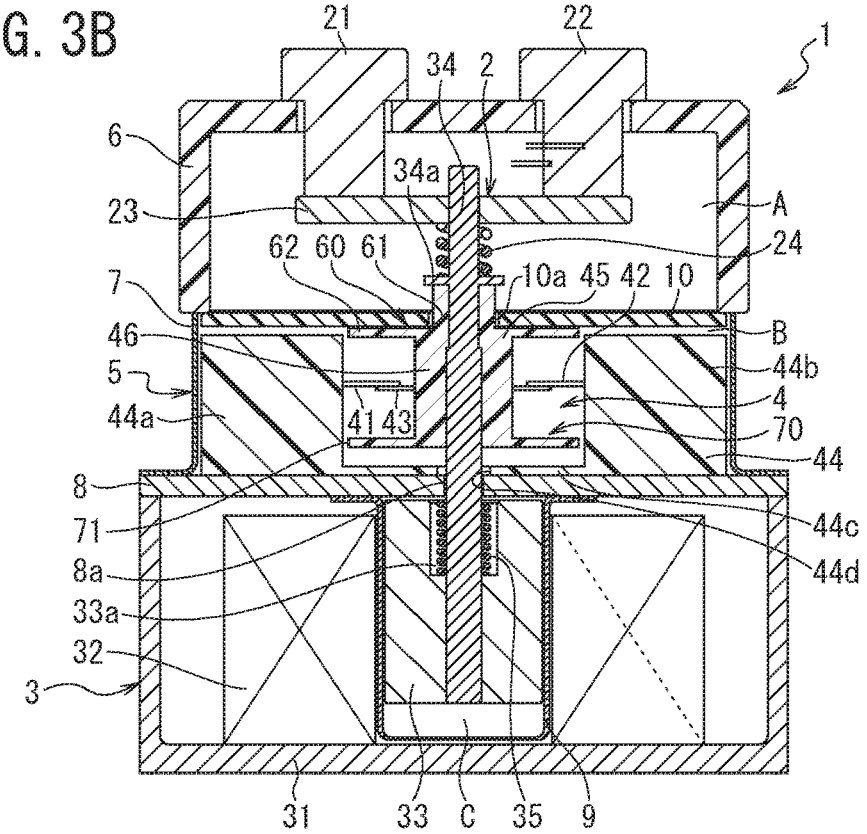

Here, as illustrated in FIGS. 1 and 2, the foreign matter invasion prevention mechanism 60 includes a cylindrical-shaped insertion portion 61. The insertion portion 61 is disposed at the top surface of the auxiliary movable contact support 46 of the auxiliary movable contact support member 45 and enters into the through-hole 10*a* on the partition wall 10. The foreign matter invasion prevention mechanism 60 includes a circular plate-shaped collar 62. The collar 62 projects outward (the horizontal direction) perpendicular to a direction that the coupling shaft 34 extends from the insertion portion 61 in the auxiliary contact mechanism housing chamber B. As illustrated in FIG. 3A, the position of the collar 62 in the vertical direction is the position upward with respect to the auxiliary-contact-side fixed contacts 41 and 42 and at which a sufficient clearance is generated between the collar 62 and the partition wall 10 in a state where the main-contact-side movable contact 23 is released and the main contact mechanism 2 is open. Additionally, as illustrated in FIG. 3B, the position of the collar 62 in the vertical direction is a position upward with respect to the auxiliary-contact-side fixed contacts 41 and 42 and at which a slight clearance (Although it seems that there is no clearance between the collar 62 and the partition wall 10 in FIG. 3B, there is a slight clearance actually.) is generated between the collar 62 and the partition wall 10 in a state where the main-contact-side movable contact 23 is in the input state and the main contact mechanism 2 is closed. A radius specifying the size of the collar 62 has a maximum size to the extent that the outer peripheral edge does not contact the one-side fixing portion 44*a* and the other-side fixing portion 44*b*.

As illustrated in FIGS. 1 and 2, the electromagnet-unit-side foreign matter invasion prevention mechanism 70 includes a circular plate-shaped electromagnet-unit-side collar 71. The electromagnet-unit-side collar 71 projects outward (the horizontal direction) perpendicular to the direction that the coupling shaft 34 extends from the lower end of the auxiliary movable contact support 46 of the auxiliary movable contact support member 45 in the auxiliary contact mechanism housing chamber B.

As illustrated in FIG. 3A, the position of the electromagnet-unit-side collar 71 in the vertical direction is the position at which a slight clearance is generated between the electromagnet-unit-side collar 71 and the coupling plate 44*c* in a state where the main-contact-side movable contact 23 is released and the main contact mechanism 2 is open. Additionally, as illustrated in FIG. 3B, the position of the electromagnet-unit-side collar 71 in the vertical direction is the position at which a sufficient clearance is generated between the electromagnet-unit-side collar 71 and the coupling plate 44*c* in a state where the main-contact-side movable contact 23 is in the input state and the main contact mechanism 2 is closed. A radius specifying the size of the electromagnet-unit-side collar 71 has a maximum size to the extent that the outer peripheral edge does not contact the one-side fixing portion 44*a* and the other-side fixing portion 44*b*.

Molding the insertion portion 61, the collar 62, and the electromagnet-unit-side collar 71 with an insulating synthetic resin integrally forms the auxiliary movable contact support member 45 with the auxiliary movable contact support 46.

The following describes behaviors of the electromagnetic contactor 1 according to the first embodiment.

Now, assume that the one main-contact-side fixed contact 21 is, for example, coupled to an electric power supply source supplying a large current and the other main-contact-side fixed contact 22 is coupled to a load device.

In this state, as illustrated in FIG. 3A, assume that the excitation coil 32 in the electromagnet unit 3 is in a non-excitation state and therefore the electromagnetic contactor 1 is in the release state in which the electromagnet unit 3 does not generate an exciting force to move up the movable plunger 33.

In this release state, the return spring 35 urges the movable plunger 33 in a downward direction separating from the upper magnetic yoke 8. In view of this, the main-contact-side movable contact 23 in the main contact mechanism 2 coupled to the movable plunger 33 via the coupling shaft 34 separates downward from the pair of main-contact-side fixed contacts 21 and 22 by a predetermined distance. In view of this, the current path between the pair of main-contact-side fixed contacts 21 and 22 is cut off and the main contact mechanism 2 is open.

From this release state, energizing the excitation coil 32 in the electromagnet unit 3 generates the exciting force at this electromagnet unit 3. As illustrated in FIG. 3B, this force pushes the movable plunger 33 upward against the urging force from the return spring 35.

When the movable plunger 33 thus moves up, the main-contact-side movable contact 23, which is coupled to the movable plunger 33 via the coupling shaft 34, also moves up, and the main-contact-side movable contact 23 in the main contact mechanism 2 contacts the pair of main-contact-side fixed contacts 21 and 22 by a contact pressure from the contact spring 24.

In view of this, the large current from the electric power supply source is supplied to the load device through the one main-contact-side fixed contact 21, the main-contact-side movable contact 23, and the other main-contact-side fixed contact 22; and the main contact mechanism 2 is closed.

When the main contact mechanism 2 enters the close state from the open state, the auxiliary-contact-side movable contacts 43 in the auxiliary contact mechanism 4 contact the respective pairs of the auxiliary-contact-side fixed contacts 41 and 42. Thus, the current flows between the respective pairs of the main-contact-side fixed contacts 21 and 22.

To cut off the current supply to the load device in the close state of the main contact mechanism 2, the energization of the electromagnet unit 3 to the excitation coil 32 is stopped.

Stopping the energization to the excitation coil 32 runs out of the exciting force to move the movable plunger 33 upward by the electromagnet unit 3; therefore, the movable plunger 33 moves down by the urging force from the return spring 35.

When this movable plunger 33 moves down, the main-contact-side movable contact 23 coupled via the coupling shaft 34 moves down. When the contact spring 24 provides the contact pressure according to this behavior, the main-contact-side movable contact 23 contacts a pair of the main-contact-side fixed contacts 21 and 22. Afterwards, when the contact pressure by the contact spring 24 disappears, the main-contact-side movable contact 23 enters a contact parting start state in which the main-contact-side movable contact 23 separates from the pair of the main-contact-side fixed contacts 21 and 22 downward.

In such contact parting start state, an arc is generated between both contact portions of the main-contact-side movable contact 23 and the contact portions of the pair of the main-contact-side fixed contacts 21 and 22, thus continuing the conductive state of the current by the arc. This arc is extinguished by an extinction device (not illustrated).

Terminating the release behavior of the movable plunger 33 terminates the contact parting.

Here, the foreign matter is possibly generated in the main contact mechanism 2 in association with the opening behavior and the closing behavior of the main-contact-side movable contact 23 in the main contact mechanism 2. For example, generation of an arc generates metal powders, and shavings are generated when the main-contact-side movable contact 23 slides to the coupling shaft 34. When this foreign matter attempts to invade the auxiliary contact mechanism housing chamber B from the main contact mechanism housing chamber A via the through-hole 10*a* on the partition wall 10, the foreign matter invasion prevention mechanism 60 prevents the invasion.

To describe specifically, since the insertion portion 61 of the foreign matter invasion prevention mechanism 60 enters into the through-hole 10*a* on the partition wall (as illustrated in FIGS. 3A and 3B, the insertion portion 61 enters into the through-hole 10*a* in both cases of the open and close main contact mechanism 2), the insertion portion 61 first blocks the invasion of the foreign matter to the auxiliary contact mechanism housing chamber B passing through the through-hole 10*a*.

Nonetheless, there is a foreign matter that passes through the clearance between the insertion portion 61 and the through-hole 10*a* and invades the auxiliary contact mechanism housing chamber B. This foreign matter rides on the collar 62, which projects outward perpendicular to the direction that the coupling shaft 34 extends from the insertion portion 61 in the auxiliary contact mechanism housing chamber B, and is captured by the collar 62. This ensures effectively blocking the attachment of the foreign matter to the auxiliary-contact-side movable contacts 43 and the auxiliary-contact-side fixed contacts 41 and 42, which are supported by the auxiliary movable contact support 46 positioned downward with respect to the collar 62.

Therefore, the foreign matter does not attach to the contact portion of the auxiliary contact mechanism 4 and does not cause the conduction failure.

Since the collar 62 also captures the foreign matter invading the inside of the main contact mechanism housing chamber A from the inside of the auxiliary contact mechanism housing chamber B via the through-hole 10*a*, the attachment of the foreign matter to the main-contact-side movable contact 23 and the main-contact-side fixed contacts 21 and 22 can be effectively blocked.

The electromagnet-unit-side foreign matter invasion prevention mechanism 70 prevents the foreign matter from invading the inside of the movable plunger housing chamber C from the inside of the auxiliary contact mechanism housing chamber B passing through the through-hole 44*d* on the coupling plate 44*c* and the through-hole 8*a* on the upper magnetic yoke 8.

To describe specifically, the electromagnet-unit-side collar 71 blocks the advance of the foreign matter invading the inside of the movable plunger housing chamber C from the inside of the auxiliary contact mechanism housing chamber B passing through the through-hole 44*d* on the coupling plate 44*c* and the through-hole 8*a* on the upper magnetic yoke 8. This ensures blocking the invasion of the foreign matter to the inside of the movable plunger housing chamber C. This ensures blocking the attachment of the foreign matter to the armature surface of the movable plunger 33, thereby allowing avoiding the cause of the behavior failure.

Conversely, the electromagnet-unit-side foreign matter invasion prevention mechanism 70 prevents the advance of the foreign matter invading the inside of the auxiliary contact mechanism housing chamber B from the inside of the movable plunger housing chamber C passing through the through-hole 8*a* on the upper magnetic yoke 8 and the through-hole 44*d* on the coupling plate 44*c*. Specifically, the electromagnet-unit-side collar 71 captures the foreign matter.

While the electromagnetic contactor 1 according to the first embodiment includes the main contact mechanism housing chamber A, the auxiliary contact mechanism housing chamber B, and the movable plunger housing chamber C in the order from the upper side to the lower side in the vertical direction, the electromagnetic contactor 1 may be laterally installed such that the main contact mechanism housing chamber A, the auxiliary contact mechanism housing chamber B, and the movable plunger housing chamber C face the horizontal direction.

In this case as well, the foreign matter invasion prevention mechanism 60 can prevent the foreign matter from invading the auxiliary contact mechanism housing chamber B from the main contact mechanism housing chamber A via the through-hole 10*a*; and can prevent the foreign matter from invading the main contact mechanism housing chamber A from the auxiliary contact mechanism housing chamber B via the through-hole 10*a*.

In this case as well, the electromagnet-unit-side foreign matter invasion prevention mechanism 70 can prevent the foreign matter from invading the movable plunger housing chamber C from the auxiliary contact mechanism housing chamber B via the through-hole 44*d* on the coupling plate 44*c* and the through-hole 8*a* on the upper magnetic yoke 8; and can prevent the foreign matter from invading the auxiliary contact mechanism housing chamber B from the movable plunger housing chamber C via the through-hole 8*a* on the upper magnetic yoke 8 and the through-hole 44*d* on the coupling plate 44*c*.

(Second Embodiment)

Figure 4:
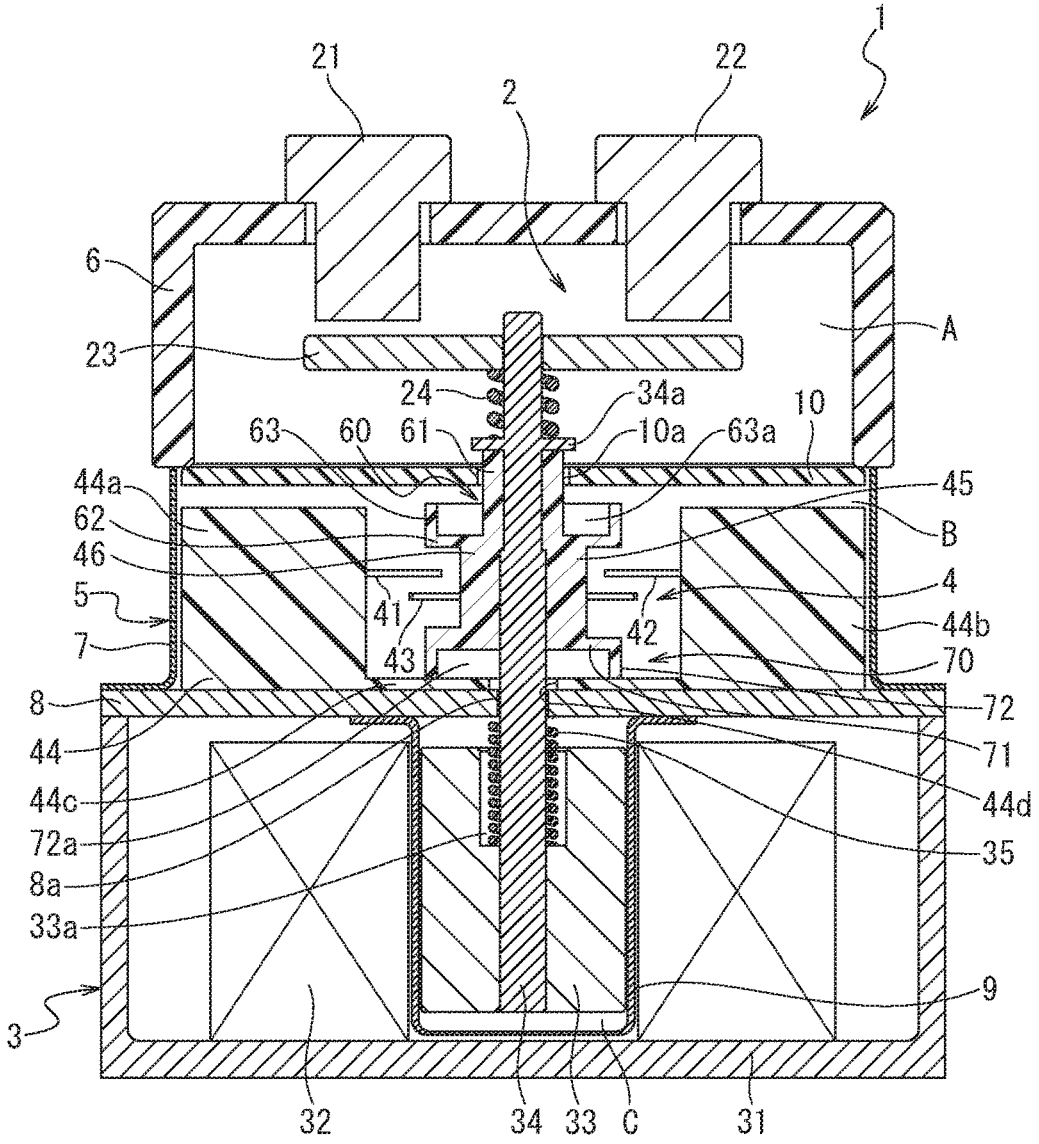
FIG. 4 is a cross-sectional view illustrating an electromagnetic contactor according to a second embodiment of the present invention.
Figure 5:
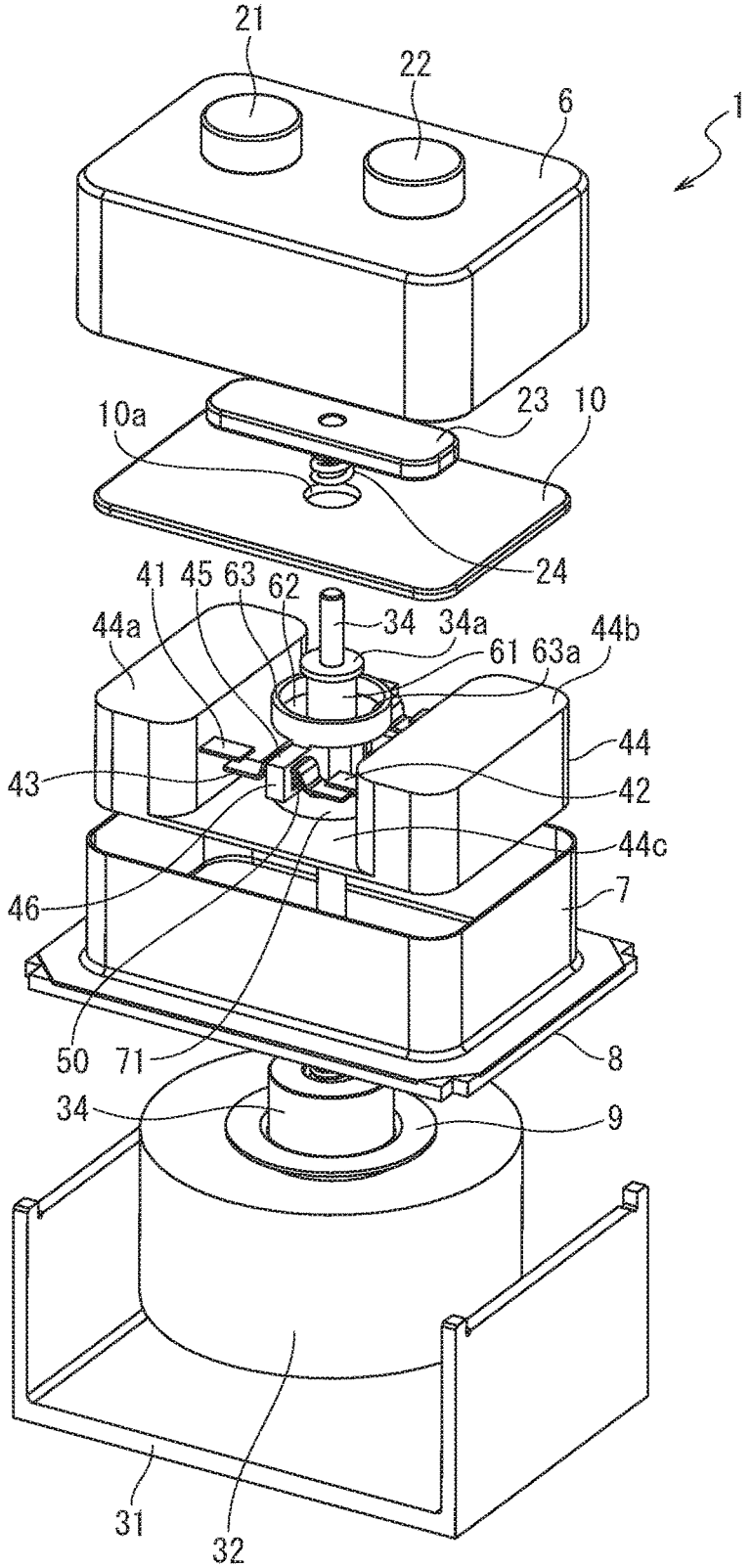
FIG. 5 is an exploded perspective view of the electromagnetic contactor illustrated in FIG. 4.

The following describes an electromagnetic contactor according to the second embodiment of the present invention with reference to FIGS. 4 and 5. In FIGS. 4 and 5, like reference numerals designate identical members illustrated in FIGS. 1 to 3A and 3B, and therefore such elements will not be further elaborated here.

While the electromagnetic contactor according to the second embodiment of the present invention has a basic structure similar to the electromagnetic contactor 1 according to the first embodiment illustrated in FIGS. 1 to 3A and 3B, configurations of the foreign matter invasion prevention mechanism 60 and the electromagnet-unit-side foreign matter invasion prevention mechanism 70 differ.

That is, similar to the electromagnetic contactor 1 according to the first embodiment, the foreign matter invasion prevention mechanism 60 in the electromagnetic contactor 1 according to the second embodiment includes the cylindrical-shaped insertion portion 61. The insertion portion 61 is disposed at the top surface of the auxiliary movable contact support 46 of the auxiliary movable contact support member 45 and enters into the through-hole 10*a* on the partition wall 10. The foreign matter invasion prevention mechanism 60 includes the circular plate-shaped collar 62. The collar 62 projects outward (the horizontal direction) perpendicular to the direction in which the coupling shaft 34 extends from the insertion portion 61 in the auxiliary contact mechanism housing chamber B.

However, different from the electromagnetic contactor 1 according to the first embodiment, the foreign matter invasion prevention mechanism 60 includes an annular-shaped outer edge 63, which projects from the outer peripheral edge of the circular plate-shaped collar 62 to the partition wall 10 in the direction that the coupling shaft 34 extends (the upward direction), and an annular-shaped depressed portion 63*a* between the outer edge 63 and the insertion portion 61.

Here, the collar 62 has a radius smaller than the radius of the collar 62 in the electromagnetic contactor 1 according to the first embodiment. Additionally, a position of the collar 62 in the vertical direction is displaced slightly downward with respect to the position of the collar 62 in the vertical direction in the electromagnetic contactor 1 according to the first embodiment.

The outer edge 63 has a height by which a sufficient clearance is generated between the outer edge 63 and the partition wall 10 in a state where the main-contact-side movable contact 23 is released and the main contact mechanism 2 is open. Additionally, the outer edge 63 has the height by which a slight clearance is generated between the outer edge 63 and the partition wall 10 in a state where the main-contact-side movable contact 23 is in the input state and the main contact mechanism 2 is closed.

Similar to the electromagnetic contactor 1 according to the first embodiment, the electromagnet-unit-side foreign matter invasion prevention mechanism 70 in the electromagnetic contactor 1 according to the second embodiment includes the circular plate-shaped electromagnet-unit-side collar 71. The electromagnet-unit-side collar 71 projects outward (the horizontal direction) perpendicular to the direction in which the coupling shaft 34 extends from the lower end of the auxiliary movable contact support 46 of the auxiliary movable contact support member 45 in the auxiliary contact mechanism housing chamber B.

However, different from the electromagnetic contactor 1 according to the first embodiment, the electromagnet-unit-side foreign matter invasion prevention mechanism 70 in the electromagnetic contactor 1 according to the second embodiment includes an annular-shaped electromagnet-unit-side outer edge 72, which projects from the outer peripheral edge of the circular plate-shaped electromagnet-unit-side collar 71 to the coupling plate (the electromagnet-unit-side partition wall) 44*c* in the direction that the coupling shaft 34 extends (the downward direction). Accordingly, an annular-shaped depressed portion 72*a* is formed at the inside of the electromagnet-unit-side outer edge 72 and outside of the coupling shaft 34.

Here, the electromagnet-unit-side collar 71 has a radius smaller than the radius of the electromagnet-unit-side collar 71 in the electromagnetic contactor 1 according to the first embodiment. Additionally, a position of the electromagnet-unit-side collar 71 in the vertical direction is displaced slightly upward with respect to the position of the electromagnet-unit-side collar 71 in the vertical direction in the electromagnetic contactor 1 according to the first embodiment.

The electromagnet-unit-side outer edge 72 has the height by which a slight clearance is generated between the electromagnet-unit-side outer edge 72 and the coupling plate 44*c* in a state where the main-contact-side movable contact 23 is released and the main contact mechanism 2 is open. Additionally, the electromagnet-unit-side outer edge 72 has the height by which a sufficient clearance is generated between the electromagnet-unit-side outer edge 72 and the coupling plate 44*c* in a state where the main-contact-side movable contact 23 is in the input state and the main contact mechanism 2 is closed.

Molding the insertion portion 61, the collar 62, the outer edge 63, the electromagnet-unit-side collar 71, and the electromagnet-unit-side outer edge 72 with an insulating synthetic resin integrally forms the auxiliary movable contact support member 45 with the auxiliary movable contact support 46.

Figure 11:
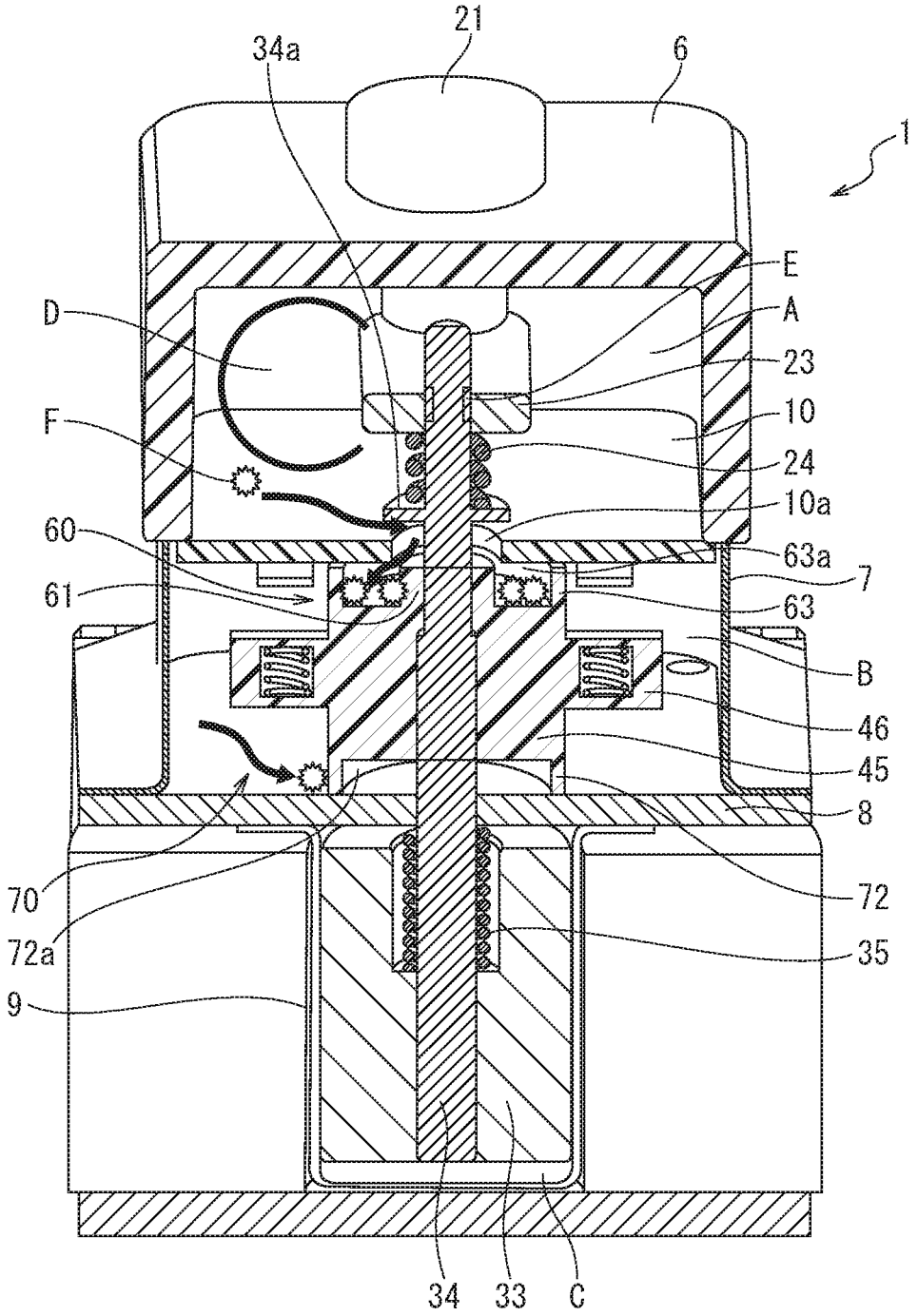
FIG. 11 is a drawing describing a foreign matter capture behavior in the electromagnetic contactor illustrated in FIG. 4.

The following describes an action of the electromagnetic contactor 1 according to the second embodiment thus configured with reference to FIG. 11.

As illustrated in FIG. 11, with the electromagnetic contactor 1 according to the second embodiment, a foreign matter F is possibly generated in association with the opening behavior and the closing behavior of the main-contact-side movable contact 23. For example, generation of an arc D generates metal powders, and shavings are generated at apart indicated by reference numeral E in FIG. 11 when the main-contact-side movable contact 23 slides to the coupling shaft 34. This foreign matter F possibly invades the inside of the auxiliary contact mechanism housing chamber B from the inside of the main contact mechanism housing chamber A via the through-hole 10*a* on the partition wall 10. Conversely, the foreign matter F possibly invades the inside of the main contact mechanism housing chamber A from the inside of the auxiliary contact mechanism housing chamber B via the through-hole 10*a* on the partition wall 10.

Further, the foreign matter F inside the auxiliary contact mechanism housing chamber B possibly passes through the through-hole 44*d* on the coupling plate (the electromagnet-unit-side partition wall) 44*c* and the through-hole 8*a* on the upper magnetic yoke 8 from the inside of the auxiliary contact mechanism housing chamber B and invades the inside of the movable plunger housing chamber C. Conversely, the foreign matter F inside the movable plunger housing chamber C possibly passes through the through-hole 8*a* on the upper magnetic yoke 8 and the through-hole 44*d* on the coupling plate 44*c* and invades the inside of the auxiliary contact mechanism housing chamber B.

Here, when this foreign matter F attempts to invade the auxiliary contact mechanism housing chamber B from the main contact mechanism housing chamber A via the through-hole 10*a* on the partition wall 10, the foreign matter invasion prevention mechanism 60 prevents the invasion.

To describe specifically, since the insertion portion 61 of the foreign matter invasion prevention mechanism 60 enters into the through-hole 10*a* on the partition wall, the insertion portion 61 first blocks the invasion of the foreign matter F to the auxiliary contact mechanism housing chamber B passing through the through-hole 10*a*. Nonetheless, as illustrated in FIG. 11, there is the foreign matter F that passes through the clearance between the insertion portion 61 and the through-hole 10*a* and invades the auxiliary contact mechanism housing chamber B. The annular-shaped depressed portion 63*a*, which is formed between the outer edge 63 and the insertion portion 61, captures this foreign matter F. This ensures further effectively blocking the attachment of the foreign matter to the auxiliary-contact-side movable contacts 43 and the auxiliary-contact-side fixed contacts 41 and 42 positioned downward with respect to the depressed portion 63*a*.

While the electromagnetic contactor 1 according to the first embodiment captures the foreign matter by the flat plate-shaped collar 62, the electromagnetic contactor 1 according to the second embodiment can capture the foreign matter by the depressed portion 63*a*, thereby ensuring improving a capture ability of the foreign matter.

Since the depressed portion 63*a* also captures the foreign matter F invading the inside of the main contact mechanism housing chamber A from the inside of the auxiliary contact mechanism housing chamber B via the through-hole 10*a*, the attachment of the foreign matter to the main-contact-side movable contact 23 and the main-contact-side fixed contacts 21 and 22 can be further effectively blocked.

The electromagnet-unit-side foreign matter invasion prevention mechanism 70 prevents the foreign matter F from invading the inside of the movable plunger housing chamber C from the inside of the auxiliary contact mechanism housing chamber B passing through the through-hole 44*d* on the coupling plate (the electromagnet-unit-side partition wall) 44*c* and the through-hole 8*a* on the upper magnetic yoke 8.

To describe specifically, the electromagnet-unit-side outer edge 72 blocks the advance of the foreign matter F invading the inside of the movable plunger housing chamber C from the inside of the auxiliary contact mechanism housing chamber B passing through the through-hole 44*d* on the coupling plate 44*c* and the through-hole 8*a* on the upper magnetic yoke 8 before the foreign matter F reaching the through-hole 44*d*. Additionally, even if the foreign matter F advances, the depressed portion 72*a* internally captures the foreign matter F. This ensures blocking the invasion of the foreign matter F to the inside of the movable plunger housing chamber C.

Conversely, the electromagnet-unit-side foreign matter invasion prevention mechanism 70 blocks the invasion of the foreign matter F invading the inside of the auxiliary contact mechanism housing chamber B from the inside of the movable plunger housing chamber C passing through the through-hole 8*a* on the upper magnetic yoke 8 and the through-hole 44*d* on the coupling plate 44*c*. Specifically, the depressed portion 72*a*, which is formed between the electromagnet-unit-side outer edge 72 and the coupling shaft 34, captures the foreign matter F.

With the electromagnetic contactor 1 according to the second embodiment as well, the electromagnetic contactor 1 may be laterally installed such that the main contact mechanism housing chamber A, the auxiliary contact mechanism housing chamber B, and the movable plunger housing chamber C face the horizontal direction.

In this case as well, the foreign matter invasion prevention mechanism 60 can prevent the foreign matter from invading the auxiliary contact mechanism housing chamber B from the main contact mechanism housing chamber A via the through-hole 10*a*; and can prevent the foreign matter from invading the main contact mechanism housing chamber A from the auxiliary contact mechanism housing chamber B via the through-hole 10*a*.

In this case as well, the electromagnet-unit-side foreign matter invasion prevention mechanism 70 can prevent the foreign matter from invading the movable plunger housing chamber C from the auxiliary contact mechanism housing chamber B via the through-hole 44*d* on the coupling plate 44*c* and the through-hole 8*a* on the upper magnetic yoke 8; and can prevent the foreign matter from invading the auxiliary contact mechanism housing chamber B from the movable plunger housing chamber C via the through-hole 8*a* on the upper magnetic yoke 8 and the through-hole 44*d* on the coupling plate 44*c*.

(Third Embodiment)

Figure 6:
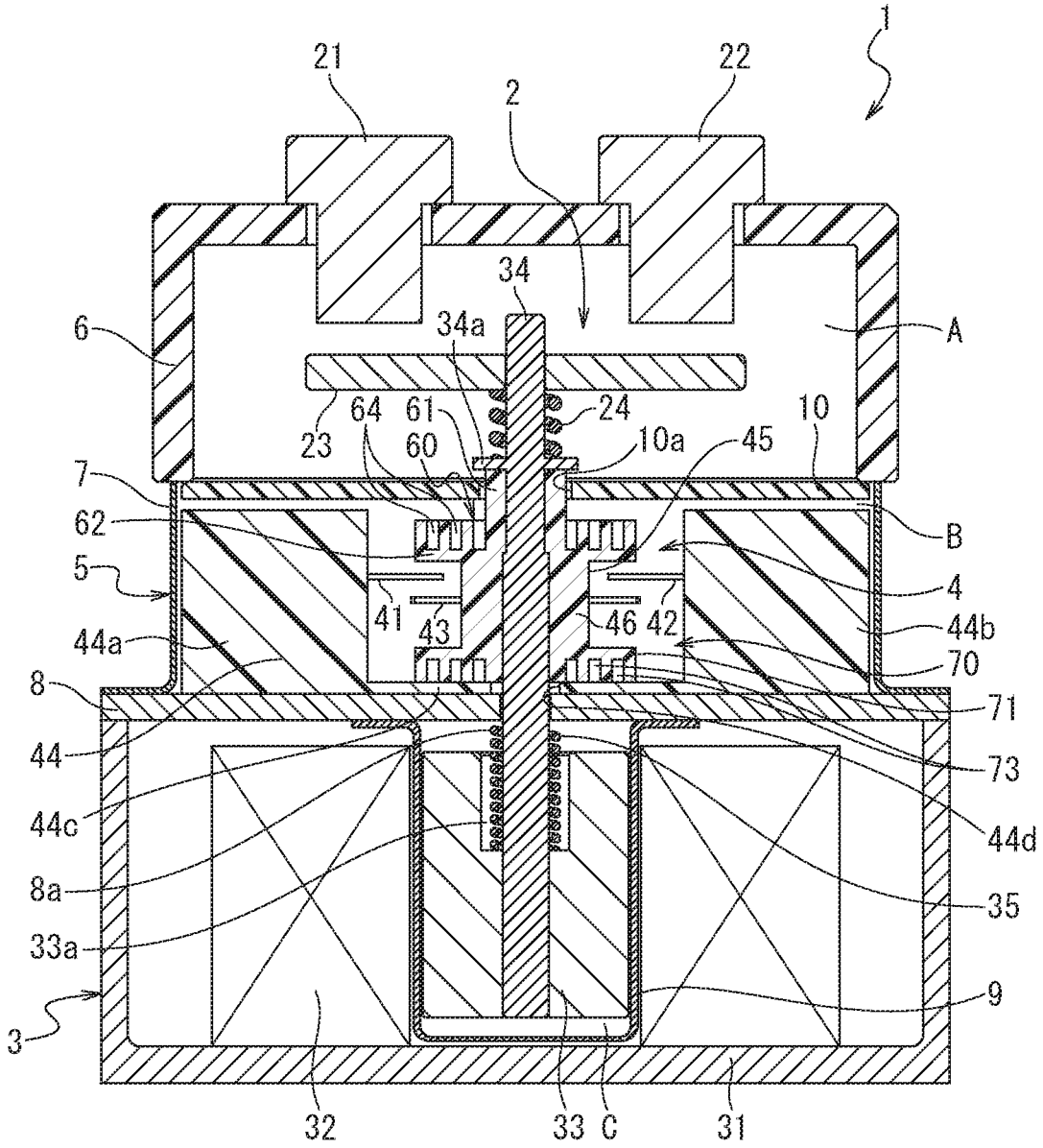
FIG. 6 is a cross-sectional view illustrating an electromagnetic contactor according to a third embodiment of the present invention.

The following describes an electromagnetic contactor according to the third embodiment of the present invention with reference to FIG. 6. In FIG. 6, like reference numerals designate identical members illustrated in FIGS. 1 to 3A and 3B, and therefore such elements will not be further elaborated here.

While the electromagnetic contactor according to the third embodiment of the present invention has a basic structure similar to the electromagnetic contactor 1 according to the first embodiment illustrated in FIGS. 1 to 3A and 3B, configurations of the foreign matter invasion prevention mechanism 60 and the electromagnet-unit-side foreign matter invasion prevention mechanism 70 differ.

That is, similar to the electromagnetic contactor 1 according to the first embodiment, the foreign matter invasion prevention mechanism 60 in the electromagnetic contactor 1 according to the third embodiment includes the cylindrical-shaped insertion portion 61. The insertion portion 61 is disposed at the top surface of the auxiliary movable contact support 46 of the auxiliary movable contact support member 45 and enters into the through-hole 10*a* on the partition wall 10. The foreign matter invasion prevention mechanism 60 includes the circular plate-shaped collar 62. The collar 62 projects outward (the horizontal direction) perpendicular to the direction that the coupling shaft 34 extends from the insertion portion 61 in the auxiliary contact mechanism housing chamber B.

However, different from the electromagnetic contactor 1 according to the first embodiment, the foreign matter invasion prevention mechanism 60 in the electromagnetic contactor 1 according to the third embodiment includes a plurality of (three in this embodiment) depressed portions 64 disposed at a surface (a top surface) of the circular plate-shaped collar 62 on the partition wall 10 side. The depressed portions 64 each have a circular ring shape around the center of the collar 62 and are formed into a circular ring shape whose radiuses increase at a predetermined pitch as the radial direction of the collar 62 increases.

Here, the collar 62 has a radius smaller than the radius of the collar 62 in the electromagnetic contactor 1 according to the first embodiment.

The collar 62 has a thickness thicker than the thickness of the collar 62 in the electromagnetic contactor 1 according to the first embodiment. The vertical direction position of the collar 62 is the vertical direction position at which a sufficient clearance is generated between the collar 62 and the partition wall 10 in a state where the main-contact-side movable contact 23 is released and the main contact mechanism 2 is open. Additionally, the vertical direction position of the collar 62 is a vertical direction position at which a slight clearance is generated between the collar 62 and the partition wall 10 in a state where the main-contact-side movable contact 23 is in the input state and the main contact mechanism 2 is closed.

Similar to the electromagnetic contactor 1 according to the first embodiment, the electromagnet-unit-side foreign matter invasion prevention mechanism 70 in the electromagnetic contactor 1 according to the third embodiment includes the circular plate-shaped electromagnet-unit-side collar 71. The electromagnet-unit-side collar 71 projects outward (the horizontal direction) perpendicular to the direction that the coupling shaft 34 extends from the lower end of the auxiliary movable contact support 46 of the auxiliary movable contact support member 45 in the auxiliary contact mechanism housing chamber B.

However, different from the electromagnetic contactor 1 according to the first embodiment, the electromagnet-unit-side foreign matter invasion prevention mechanism 70 in the electromagnetic contactor 1 according to the third embodiment includes a plurality of electromagnet-unit-side depressed portions 73, which are disposed at a surface (a lower surface) of the circular plate-shaped electromagnet-unit-side collar 71 on the coupling plate 44*c* side. The electromagnet-unit-side depressed portions 73 each have a circular ring shape around the center of the electromagnet-unit-side collar 71 and are formed into a circular ring shape whose radiuses increase at a predetermined pitch as the radial direction of the electromagnet-unit-side collar 71 increases.

Here, the electromagnet-unit-side collar 71 has a radius smaller than the radius of the electromagnet-unit-side collar 71 in the electromagnetic contactor 1 according to the first embodiment.

The electromagnet-unit-side collar 71 has a thickness thicker than the thickness of the electromagnet-unit-side collar 71 in the electromagnetic contactor 1 according to the first embodiment. The vertical direction position of the electromagnet-unit-side collar 71 is the position at which a slight clearance is generated between the electromagnet-unit-side collar 71 and the coupling plate 44*c* in a state where the main-contact-side movable contact 23 is released and the main contact mechanism 2 is open. Additionally, the vertical direction position of the electromagnet-unit-side collar 71 is the vertical direction position at which a sufficient clearance is generated between the electromagnet-unit-side collar 71 and the coupling plate 44*c* in a state where the main-contact-side movable contact 23 is in the input state and the main contact mechanism 2 is closed.

Molding the insertion portion 61, the collar 62 with the plurality of depressed portions 64, and the electromagnet-unit-side collar 71 with the plurality of electromagnet-unit-side depressed portions 73 with an insulating synthetic resin integrally forms the auxiliary movable contact support member 45 with the auxiliary movable contact support 46.

With the electromagnetic contactor 1 according to the third embodiment thus configured, similar to the electromagnetic contactors 1 according to the first and the second embodiments, when the foreign matter inside the main contact mechanism housing chamber A attempts to invade the auxiliary contact mechanism housing chamber B from the main contact mechanism housing chamber A via the through-hole 10*a* on the partition wall 10, the foreign matter invasion prevention mechanism 60 can prevent the invasion.

To describe specifically, since the insertion portion 61 of the foreign matter invasion prevention mechanism 60 enters into the through-hole 10*a* on the partition wall, the insertion portion 61 first blocks the invasion of the foreign matter to the auxiliary contact mechanism housing chamber B passing through the through-hole 10*a*.

The foreign matter nonetheless invading the auxiliary contact mechanism housing chamber B passing through the clearance between the insertion portion 61 and the through-hole 10*a* is captured by the plurality of (three in this embodiment) depressed portions 64, which are disposed on the surface (the top surface) of the collar 62 on the partition wall 10 side. This ensures further effectively blocking the attachment of the foreign matter to the auxiliary-contact-side movable contacts 43 and the auxiliary-contact-side fixed contacts 41 and 42 positioned downward with respect to the depressed portions 64.

While the electromagnetic contactor 1 according to the first embodiment captures the foreign matter by the flat plate-shaped collar 62, the electromagnetic contactor 1 according to the third embodiment can capture the foreign matter by the plurality of depressed portions 64, thereby ensuring improving a capture ability of the foreign matter.

Since the plurality of depressed portions 64 also capture the foreign matter invading the inside of the main contact mechanism housing chamber A from the inside of the auxiliary contact mechanism housing chamber B via the through-hole 10*a*, the attachment of the foreign matter to the main-contact-side movable contact 23 and the main-contact-side fixed contacts 21 and 22 can be further effectively blocked.

The electromagnet-unit-side foreign matter invasion prevention mechanism 70 prevents the foreign matter from invading the inside of the movable plunger housing chamber C from the inside of the auxiliary contact mechanism housing chamber B passing through the through-hole 44*d* on the coupling plate 44*c* and the through-hole 8*a* on the upper magnetic yoke 8.

To describe specifically, the electromagnet-unit-side collar 71 blocks the advance of the foreign matter invading the inside of the movable plunger housing chamber C from the inside of the auxiliary contact mechanism housing chamber B passing through the through-hole 44*d* on the coupling plate 44*c* and the through-hole 8*a* on the upper magnetic yoke 8 by the thickness. Even if the foreign matter advances, the plurality of electromagnet-unit-side depressed portions 73 capture the foreign matter. This ensures blocking the invasion of the foreign matter F to the inside of the movable plunger housing chamber C.

Conversely, the electromagnet-unit-side foreign matter invasion prevention mechanism 70 blocks the invasion of the foreign matter F invading the inside of the auxiliary contact mechanism housing chamber B from the inside of the movable plunger housing chamber C passing through the through-hole 8*a* on the upper magnetic yoke 8 and the through-hole 44*d* on the coupling plate 44*c*. Specifically, the plurality of electromagnet-unit-side depressed portions 73 capture the foreign matter F.

With the electromagnetic contactor 1 according to the third embodiment as well, the electromagnetic contactor 1 may be laterally installed such that the main contact mechanism housing chamber A, the auxiliary contact mechanism housing chamber B, and the movable plunger housing chamber C face the horizontal direction.

In this case as well, the foreign matter invasion prevention mechanism 60 can prevent the foreign matter from invading the auxiliary contact mechanism housing chamber B from the main contact mechanism housing chamber A via the through-hole 10*a*; and can prevent the foreign matter from invading the main contact mechanism housing chamber A from the auxiliary contact mechanism housing chamber B via the through-hole 10*a*.

In this case as well, the electromagnet-unit-side foreign matter invasion prevention mechanism 70 can prevent the foreign matter from invading the movable plunger housing chamber C from the auxiliary contact mechanism housing chamber B via the through-hole 44*d* on the coupling plate 44*c* and the through-hole 8*a* on the upper magnetic yoke 8; and can prevent the foreign matter from invading the auxiliary contact mechanism housing chamber B from the movable plunger housing chamber C via the through-hole 8*a* on the upper magnetic yoke 8 and the through-hole 44*d* on the coupling plate 44*c*.

(Fourth Embodiment)

Figure 7:
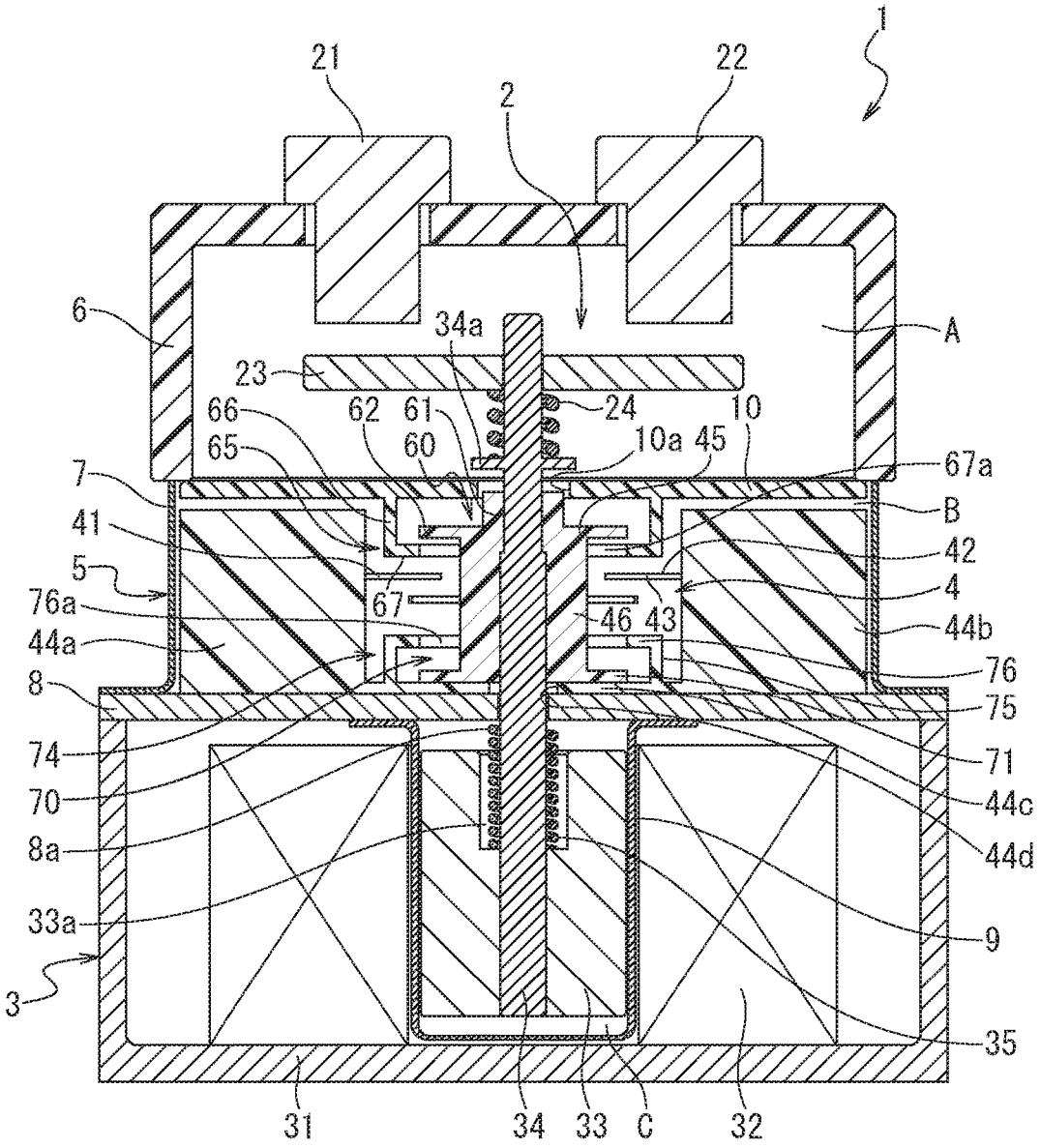
FIG. 7 is a cross-sectional view illustrating an electromagnetic contactor according to a fourth embodiment of the present invention.

The following describes an electromagnetic contactor according to the fourth embodiment of the present invention with reference to FIG. 7. In FIG. 7, like reference numerals designate identical members illustrated in FIGS. 1 to 3A and 3B, and therefore such elements will not be further elaborated here.

While the electromagnetic contactor 1 according to the fourth embodiment of the present invention has a basic structure similar to the electromagnetic contactor 1 according to the first embodiment illustrated in FIGS. 1 to 3A and 3B, configurations of the foreign matter invasion prevention mechanism 60 and the electromagnet-unit-side foreign matter invasion prevention mechanism 70 differ.

That is, similar to the electromagnetic contactor 1 according to the first embodiment, the foreign matter invasion prevention mechanism 60 in the electromagnetic contactor 1 according to the fourth embodiment includes the cylindrical-shaped insertion portion 61. The insertion portion 61 is disposed at the top surface of the auxiliary movable contact support 46 of the auxiliary movable contact support member 45 and enters into the through-hole 10*a* on the partition wall 10. The foreign matter invasion prevention mechanism 60 includes the circular plate-shaped collar 62. The collar 62 projects outward (the horizontal direction) perpendicular to the direction that the coupling shaft 34 extends from the insertion portion 61 in the auxiliary contact mechanism housing chamber B.

However, different from the electromagnetic contactor 1 according to the first embodiment, the foreign matter invasion prevention mechanism 60 in the electromagnetic contactor 1 according to the fourth embodiment includes a foreign matter invasion prevention auxiliary portion 65 formed of a cylindrical-shaped protrusion 66 and a plate 67 so as to cover the outside of the collar 62. The protrusion 66 extends from a surface (the lower surface) of the partition wall 10 on the auxiliary contact mechanism housing chamber B side in the extension direction (the downward direction) of the coupling shaft 34. The plate 67 extends from the distal end of the protrusion 66 to the through-hole 10*a* parallel to the partition wall 10.

Here, the collar 62 has a radius smaller than the radius of the collar 62 in the electromagnetic contactor 1 according to the first embodiment.

While the plate 67 of the foreign matter invasion prevention auxiliary portion 65 is formed so as to cover the lower side of the collar 62, a through-hole 67*a* into which the auxiliary movable contact support member 45 is insertable is formed at the center of the plate 67.

The position of the collar 62 in the vertical direction is the position at which a sufficient clearance is generated between the collar 62 and the partition wall 10 and a slight clearance is generated between the collar 62 and the plate 67 in a state where the main-contact-side movable contact 23 is released and the main contact mechanism 2 is open. Additionally, the vertical direction position of the collar 62 is a vertical direction position at which a slight clearance is generated between the collar 62 and the partition wall 10 in a state where the main-contact-side movable contact 23 is in the input state and the main contact mechanism 2 is closed.

Similar to the electromagnetic contactor 1 according to the first embodiment, the electromagnet-unit-side foreign matter invasion prevention mechanism 70 in the electromagnetic contactor 1 according to the fourth embodiment includes the circular plate-shaped electromagnet-unit-side collar 71. The electromagnet-unit-side collar 71 projects outward (the horizontal direction) perpendicular to the direction that the coupling shaft 34 extends from the lower end of the auxiliary movable contact support 46 of the auxiliary movable contact support member 45 in the auxiliary contact mechanism housing chamber B.

However, different from the electromagnetic contactor 1 according to the first embodiment, the electromagnet-unit-side foreign matter invasion prevention mechanism 70 in the electromagnetic contactor 1 according to the fourth embodiment includes an electromagnet-unit-side foreign matter invasion prevention auxiliary portion 74 formed of a cylindrical-shaped electromagnet-unit-side protrusion 75 and an electromagnet-unit-side plate 76 so as to cover the outside of the electromagnet-unit-side collar 71. The electromagnet-unit-side protrusion 75 extends from a surface (the top surface) of the coupling plate 44*c* (the electromagnet-unit-side partition wall) on the auxiliary contact mechanism housing chamber B side in the extension direction (the upward direction) of the coupling shaft 34. The electromagnet-unit-side plate 76 extends from the distal end of the electromagnet-unit-side protrusion 75 to the through-hole 44*d* on the coupling plate 44*c* parallel to the coupling plate 44*c*.

Here, the electromagnet-unit-side collar 71 has a radius smaller than the radius of the electromagnet-unit-side collar 71 in the electromagnetic contactor 1 according to the first embodiment.

While the electromagnet-unit-side plate 76 of the electromagnet-unit-side foreign matter invasion prevention auxiliary portion 74 is formed so as to cover the upper side of the electromagnet-unit-side collar 71, a through-hole 76*a* through which the auxiliary movable contact support member 45 is insertable is formed at the center of the electromagnet-unit-side plate 76.

The position of the electromagnet-unit-side collar 71 in the vertical direction is the position at which a slight clearance is generated between the electromagnet-unit-side collar 71 and the coupling plate 44*c* and a sufficient clearance is generated between the electromagnet-unit-side collar 71 and the electromagnet-unit-side plate 76 in a state where the main-contact-side movable contact 23 is released and the main contact mechanism 2 is open. Additionally, the vertical direction position of the electromagnet-unit-side collar 71 is the position at which a sufficient clearance is generated between the electromagnet-unit-side collar 71 and the coupling plate 44*c* and a slight clearance is generated between the electromagnet-unit-side collar 71 and the electromagnet-unit-side plate 76 in a state where the main-contact-side movable contact 23 is in the input state and the main contact mechanism 2 is closed.

Molding the insertion portion 61, the collar 62, and the electromagnet-unit-side collar 71 with an insulating synthetic resin integrally forms the auxiliary movable contact support member 45 with the auxiliary movable contact support 46.

The partition wall 10 is integrally formed by molding the insulating synthetic resin including the foreign matter invasion prevention auxiliary portion 65.

Further, the auxiliary fixed contact support member 44 is formed integrally with the one-side fixing portion 44*a*, the other-side fixing portion 44*b*, and the coupling plate 44*c* including the electromagnet-unit-side foreign matter invasion prevention auxiliary portion 74.

With the electromagnetic contactor 1 according to the fourth embodiment thus configured, similar to the electromagnetic contactors 1 according to the first to the third embodiments, when the foreign matter inside the main contact mechanism housing chamber A attempts to invade the auxiliary contact mechanism housing chamber B from the main contact mechanism housing chamber A via the through-hole 10*a* on the partition wall 10, the foreign matter invasion prevention mechanism 60 can prevent the invasion.

To describe specifically, since the insertion portion 61 of the foreign matter invasion prevention mechanism 60 enters into the through-hole 10*a* on the partition wall, the insertion portion 61 first blocks the invasion of the foreign matter to the auxiliary contact mechanism housing chamber B passing through the through-hole 10*a*.

The foreign matter nonetheless invading the auxiliary contact mechanism housing chamber B passing through the clearance between the insertion portion 61 and the through-hole 10*a* is captured on the top surface of the collar 62. The foreign matter invasion prevention auxiliary portion 65 captures the foreign matter fallen from the top surface of the collar 62. This ensures further effectively blocking the attachment of the foreign matter to the auxiliary-contact-side movable contacts 43 and the auxiliary-contact-side fixed contacts 41 and 42.

While the electromagnetic contactor 1 according to the first embodiment captures the foreign matter by the flat plate-shaped collar 62, the electromagnetic contactor 1 according to the fourth embodiment captures the foreign matter fallen from the top surface of the collar 62 by the foreign matter invasion prevention auxiliary portion 65, thereby ensuring further improving the capture ability of the foreign matter.

Since the collar 62 and the foreign matter invasion prevention auxiliary portion 65 also capture the foreign matter invading the inside of the main contact mechanism housing chamber A from the inside of the auxiliary contact mechanism housing chamber B via the through-hole 10*a*, the attachment of the foreign matter to the main-contact-side movable contact 23 and the main-contact-side fixed contacts 21 and 22 can be further effectively blocked.

The electromagnet-unit-side foreign matter invasion prevention mechanism 70 prevents the foreign matter from invading the inside of the movable plunger housing chamber C from the inside of the auxiliary contact mechanism housing chamber B passing through the through-hole 44*d* on the coupling plate 44*c* and the through-hole 8*a* on the upper magnetic yoke 8.

To describe specifically, the electromagnet-unit-side foreign matter invasion prevention auxiliary portion 74 first blocks the advance of the foreign matter invading the inside of the movable plunger housing chamber C from the inside of the auxiliary contact mechanism housing chamber B passing through the through-hole 44*d* on the coupling plate 44*c* and the through-hole 8*a* on the upper magnetic yoke 8. Even if the foreign matter advances, the electromagnet-unit-side collar 71 captures the foreign matter. This ensures blocking the invasion of the foreign matter to the inside of the movable plunger housing chamber C.

Conversely, the electromagnet-unit-side foreign matter invasion prevention mechanism 70 blocks the invasion of the foreign matter F invading the inside of the auxiliary contact mechanism housing chamber B from the inside of the movable plunger housing chamber C passing through the through-hole 8*a* on the upper magnetic yoke 8 and the through-hole 44*d* on the coupling plate 44*c*. Specifically, the electromagnet-unit-side collar 71 and the electromagnet-unit-side foreign matter invasion prevention auxiliary portion 74 capture the foreign matter.

With the electromagnetic contactor 1 according to the fourth embodiment as well, the electromagnetic contactor 1 may be laterally installed such that the main contact mechanism housing chamber A, the auxiliary contact mechanism housing chamber B, and the movable plunger housing chamber C face the horizontal direction.

In this case as well, the foreign matter invasion prevention mechanism 60 can prevent the foreign matter from invading the auxiliary contact mechanism housing chamber B from the main contact mechanism housing chamber A via the through-hole 10*a*; and can prevent the foreign matter from invading the main contact mechanism housing chamber A from the auxiliary contact mechanism housing chamber B via the through-hole 10*a*.

In this case as well, the electromagnet-unit-side foreign matter invasion prevention mechanism 70 can prevent the foreign matter from invading the movable plunger housing chamber C from the auxiliary contact mechanism housing chamber B via the through-hole 44*d* on the coupling plate 44*c* and the through-hole 8*a* on the upper magnetic yoke 8; and can prevent the foreign matter from invading the auxiliary contact mechanism housing chamber B from the movable plunger housing chamber C via the through-hole 8*a* on the upper magnetic yoke 8 and the through-hole 44*d* on the coupling plate 44*c*.

(Fifth Embodiment)

Figure 8:
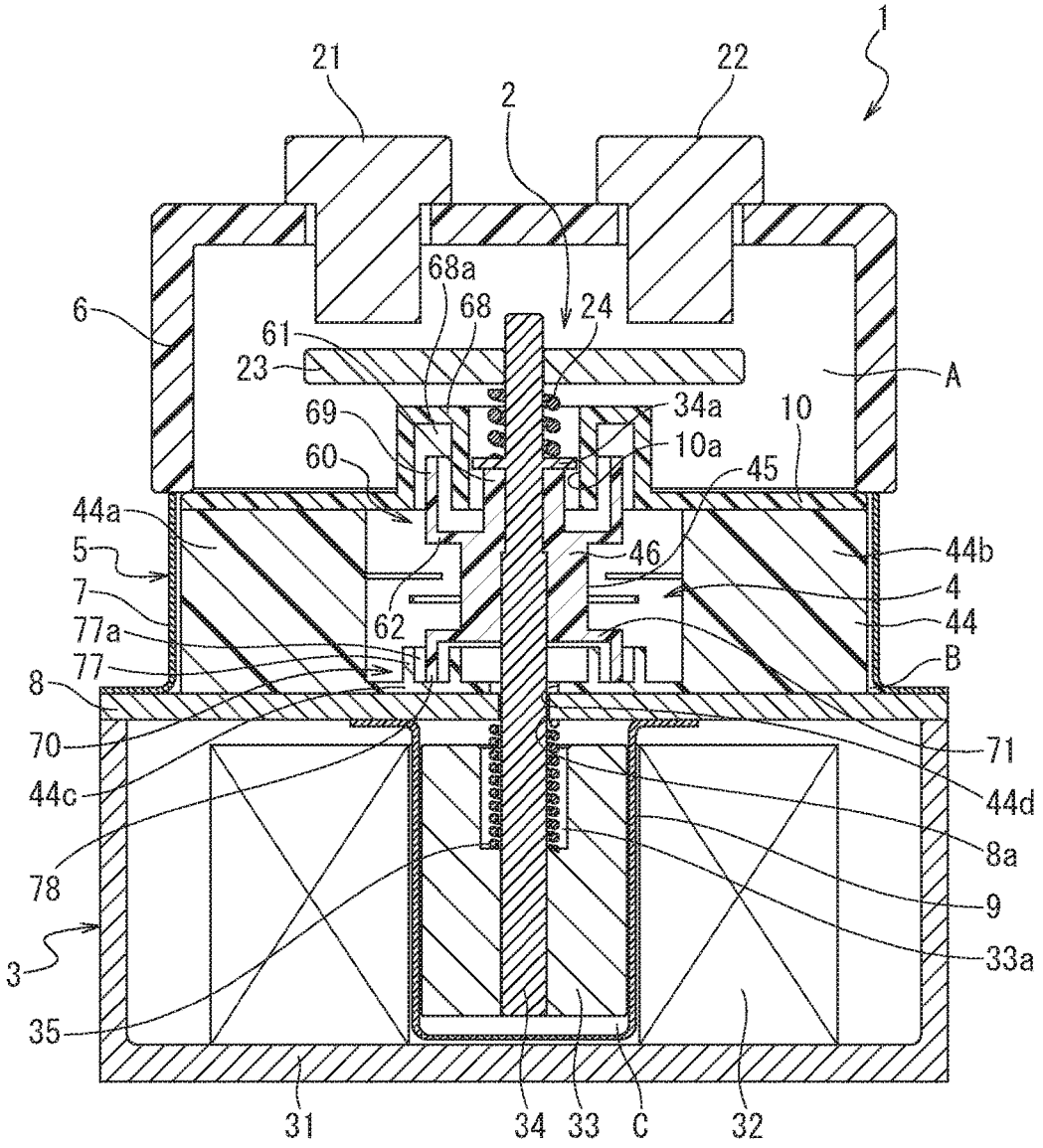
FIG. 8 is a cross-sectional view illustrating an electromagnetic contactor according to a fifth embodiment of the present invention.
Figure 9:
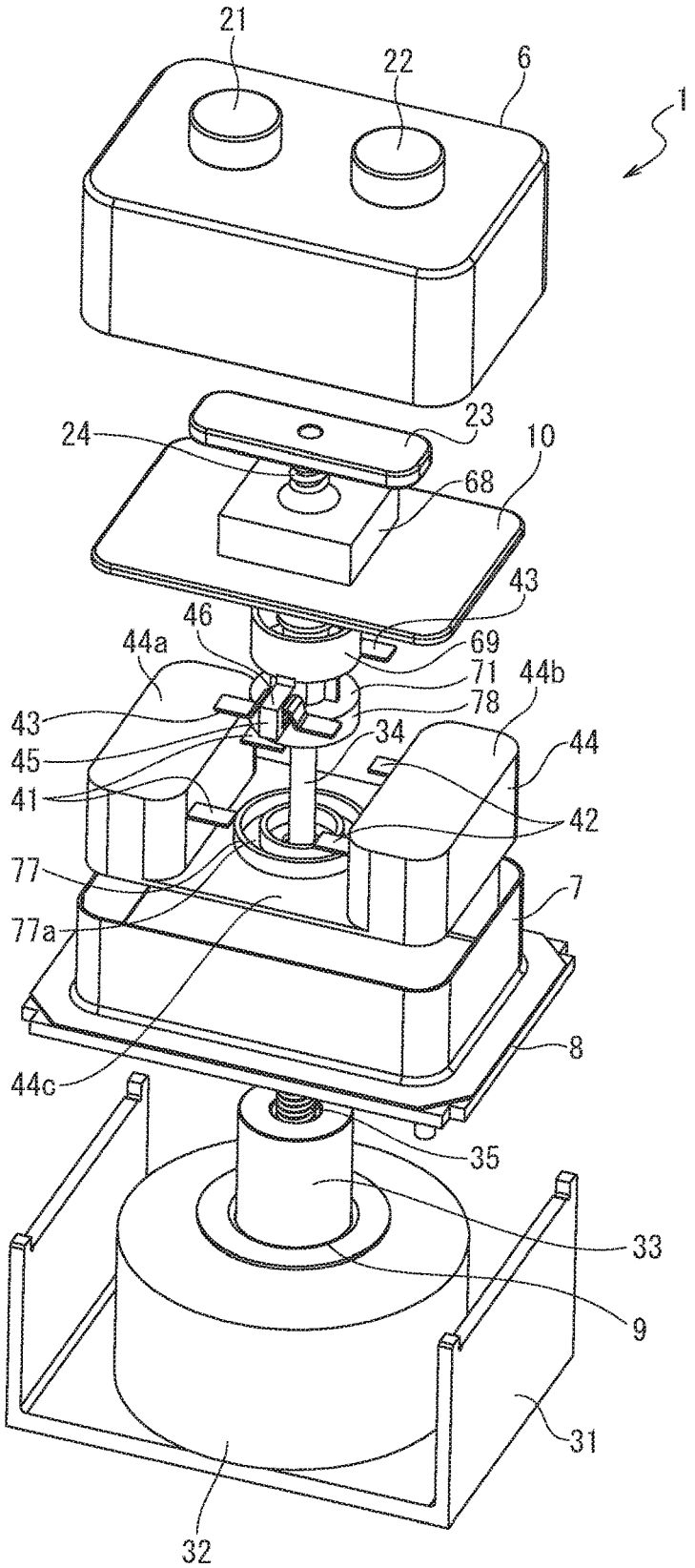
FIG. 9 is an exploded perspective view viewing the electromagnetic contactor illustrated in FIG. 8 from obliquely upward.
Figure 10:
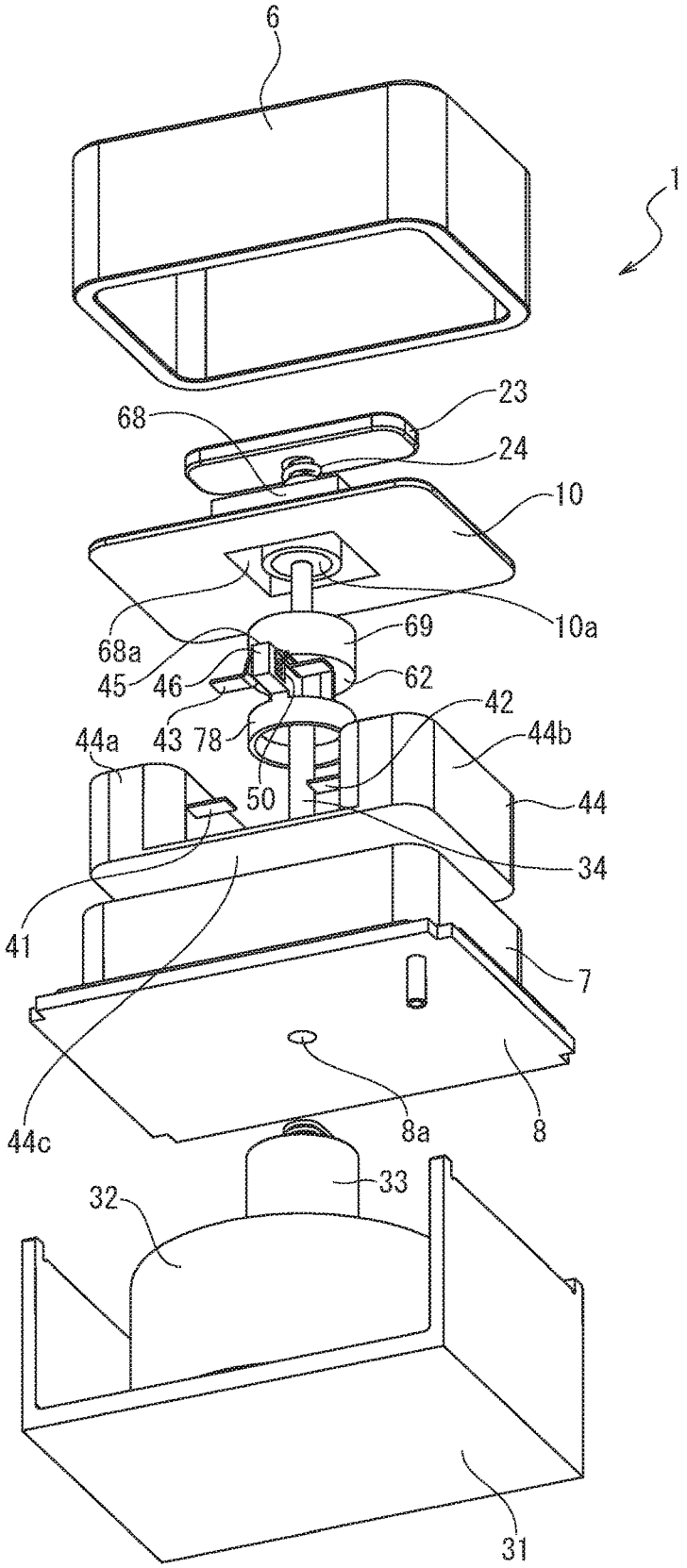
FIG. 10 is an exploded perspective view viewing the electromagnetic contactor illustrated in FIG. 8 from obliquely downward.

The following describes an electromagnetic contactor according to the fifth embodiment of the present invention with reference to FIGS. 8 to 10. In FIGS. 8 to 10, like reference numerals designate identical members illustrated in FIGS. 1 to 3A and 3B, and therefore such elements will not be further elaborated here.

While the electromagnetic contactor 1 according to the fifth embodiment of the present invention has a basic structure similar to the electromagnetic contactor 1 according to the first embodiment illustrated in FIGS. 1 to 3A and 3B, configurations of the foreign matter invasion prevention mechanism 60 and the electromagnet-unit-side foreign matter invasion prevention mechanism 70 differ.

That is, similar to the electromagnetic contactor 1 according to the first embodiment, the foreign matter invasion prevention mechanism 60 in the electromagnetic contactor 1 according to the fifth embodiment includes the cylindrical-shaped insertion portion 61. The insertion portion 61 is disposed at the top surface of the auxiliary movable contact support 46 of the auxiliary movable contact support member 45 and enters into the through-hole 10*a* on the partition wall 10. The foreign matter invasion prevention mechanism 60 includes the circular plate-shaped collar 62. The collar 62 projects outward (the horizontal direction) perpendicular to the direction in which the coupling shaft 34 extends from the insertion portion 61 in the auxiliary contact mechanism housing chamber B.

However, different from the electromagnetic contactor 1 according to the first embodiment, the foreign matter invasion prevention mechanism 60 in the electromagnetic contactor 1 according to the fifth embodiment includes a depressed portion formation portion 68 and a cylindrical-shaped edge 69. The depressed portion formation portion 68 of the partition wall 10 forms a depressed portion 68*a* at the peripheral area of the through-hole 10*a* on the partition wall 10. The edge 69 extends from the outer peripheral edge of the collar 62 to the inside of the depressed portion 68*a* on the partition wall 10 in the extension direction (the upward direction) of the coupling shaft 34. The depressed portion formation portion 68 is formed by depressing the partition wall 10 such that the depressed portion 68*a* is formed at the peripheral area of the through-hole 10*a*.

Here, the collar 62 has a radius smaller than the radius of the collar 62 in the electromagnetic contactor 1 according to the first embodiment.

The position of the collar 62 in the vertical direction is the position at which a sufficient clearance is generated between the collar 62 and the partition wall 10 in a state where the main-contact-side movable contact 23 is released and the main contact mechanism 2 is open. Additionally, the vertical direction position of the collar 62 is a vertical direction position at which a slight clearance is generated between the collar 62 and the partition wall 10 in a state where the main-contact-side movable contact 23 is in the input state and the main contact mechanism 2 is closed.

The length of the edge 69 and the depth of the depressed portion 68*a* on the partition wall 10 are the length and the depth of forming a region where the edge 69 mutually overlaps with the depressed portion 68*a* in a state where the main-contact-side movable contact 23 is released and the main contact mechanism 2 is open and in a state where the main-contact-side movable contact 23 is in the input state and the main contact mechanism 2 is closed. Similar to the electromagnetic contactor 1 according to the first embodiment, the electromagnet-unit-side foreign matter invasion prevention mechanism 70 in the electromagnetic contactor 1 according to the fifth embodiment includes the circular plate-shaped electromagnet-unit-side collar 71. The electromagnet-unit-side collar 71 projects outward (the horizontal direction) perpendicular to the direction in which the coupling shaft 34 extends from the lower end of the auxiliary movable contact support 46 of the auxiliary movable contact support member 45 in the auxiliary contact mechanism housing chamber B.

However, different from the electromagnetic contactor 1 according to the first embodiment, the electromagnet-unit-side foreign matter invasion prevention mechanism 70 in the electromagnetic contactor 1 according to the fifth embodiment includes an electromagnet-unit-side depressed portion formation portion 77 of the coupling plate 44*c*, which forms a depressed portion 77*a* at the peripheral area of the through-hole 44*d* on the coupling plate 44*c* (the electromagnet-unit-side partition wall), and an electromagnet-unit-side edge 78, which extends from the outer peripheral edge of the electromagnet-unit-side collar 71 to the depressed portion 77*a* of the coupling plate 44*c* in the extension direction (the downward direction) of the coupling shaft 34. The electromagnet-unit-side depressed portion formation portion 77 is formed on the top surface of the coupling plate 44*c* so as to form the depressed portion 77*a* at the peripheral area of the through-hole 44*d* on the coupling plate 44*c*.

Here, the electromagnet-unit-side collar 71 has a radius smaller than the radius of the electromagnet-unit-side collar 71 in the electromagnetic contactor 1 according to the first embodiment.

The position of the electromagnet-unit-side collar 71 in the vertical direction is the position at which a slight clearance is generated between the electromagnet-unit-side collar 71 and the electromagnet-unit-side depressed portion formation portion 77 in a state where the main-contact-side movable contact 23 is released and the main contact mechanism 2 is open. Additionally, the vertical direction position of the electromagnet-unit-side collar 71 is the vertical direction position at which a sufficient clearance is generated between the electromagnet-unit-side collar 71 and the electromagnet-unit-side depressed portion formation portion 77 in a state where the main-contact-side movable contact 23 is in the input state and the main contact mechanism 2 is closed.

The length of the electromagnet-unit-side edge 78 and the depth of the depressed portion 77*a* are the length and the depth of forming a region where the electromagnet-unit-side edge 78 mutually overlaps with the depressed portion 77*a* in a state where the main-contact-side movable contact 23 is released and the main contact mechanism 2 is open and in a state where the main-contact-side movable contact 23 is in the input state and the main contact mechanism 2 is closed.

Molding the insertion portion 61, the collar 62, the edge 69, the electromagnet-unit-side collar 71, and the electromagnet-unit-side edge 78 with an insulating synthetic resin integrally forms the auxiliary movable contact support member 45 with the auxiliary movable contact support 46.

The partition wall 10 is integrally formed by molding the insulating synthetic resin including the depressed portion formation portion 68.

Further, the auxiliary fixed contact support member 44 is formed integrally with the one-side fixing portion 44*a*, the other-side fixing portion 44*b*, and the coupling plate 44*c* including the electromagnet-unit-side depressed portion formation portion 77.

With the electromagnetic contactor 1 according to the fifth embodiment thus configured, similar to the electromagnetic contactors 1 according to the first to the fourth embodiments, when the foreign matter inside the main contact mechanism housing chamber A attempts to invade the auxiliary contact mechanism housing chamber B from the main contact mechanism housing chamber A via the through-hole 10*a* on the partition wall 10, the foreign matter invasion prevention mechanism 60 can prevent the invasion.

To describe specifically, since the insertion portion 61 of the foreign matter invasion prevention mechanism 60 enters into the through-hole 10*a* on the partition wall, the insertion portion 61 first blocks the invasion of the foreign matter to the auxiliary contact mechanism housing chamber B passing through the through-hole 10*a*.

The foreign matter nonetheless invading the auxiliary contact mechanism housing chamber B passing through the clearance between the insertion portion 61 and the through-hole 10*a* is captured on the top surface of the collar 62. Additionally, since the cylindrical-shaped edge 69 extends from the outer peripheral edge of the collar 62 in the direction (the upward direction) in which the coupling shaft 34 extends, this ensures reducing a possibility that the foreign matter climbs over the edge 69 and invades the inside of the auxiliary contact mechanism housing chamber B on the outside. Furthermore, the edge 69 extends up to the inside of the depressed portion 68*a* formed on the partition wall 10. This forms the region where the edge 69 overlaps with the depressed portion 68*a*; therefore, even if the foreign matter climbs over the edge 69, the depressed portion 68*a* captures the foreign matter. The length of the edge 69 and the depth of the depressed portion 68*a* are configured to the length and the depth of forming the region where the edge 69 mutually overlaps with the depressed portion 68*a* in a state where the main-contact-side movable contact 23 is released and the main contact mechanism 2 is open and in a state where the main-contact-side movable contact 23 is in the input state and the main contact mechanism 2 is closed. In view of this, the region where the edge 69 mutually overlaps with the depressed portion 68*a* is present in both cases of the main contact mechanism 2 being open and the main contact mechanism 2 being closed, thereby allowing reducing a possibility of the foreign matter invading the inside of the auxiliary contact mechanism housing chamber B regardless of whether the main contact mechanism 2 is open or closed. This ensures further effectively blocking the attachment of the foreign matter to the auxiliary-contact-side movable contacts 43 and the auxiliary-contact-side fixed contacts 41 and 42.

Since the depressed portion 68*a* and the collar 62 can capture the foreign matter invading the inside of the main contact mechanism housing chamber A from the inside of the auxiliary contact mechanism housing chamber B via the through-hole 10*a*, the attachment of the foreign matter to the main-contact-side movable contact 23 and the main-contact-side fixed contacts 21 and 22 can be further effectively blocked.

The electromagnet-unit-side foreign matter invasion prevention mechanism 70 prevents the foreign matter from invading the inside of the movable plunger housing chamber C from the inside of the auxiliary contact mechanism housing chamber B passing through the through-hole 44*d* on the coupling plate 44*c* and the through-hole 8*a* on the upper magnetic yoke 8.

To describe specifically, the electromagnet-unit-side depressed portion formation portion 77 first blocks the advance of the foreign matter invading the inside of the movable plunger housing chamber C from the inside of the auxiliary contact mechanism housing chamber B passing through the through-hole 44*d* on the coupling plate 44*c* and the through-hole 8*a* on the upper magnetic yoke 8. Even if the foreign matter advances, the depressed portion 77*a* captures the foreign matter. The length of the electromagnet-unit-side edge 78 and the depth of the depressed portion 77*a* are configured to the length and the depth of forming the region where the electromagnet-unit-side edge 78 mutually overlaps with the depressed portion 77*a* in a state where the main-contact-side movable contact 23 is released and the main contact mechanism 2 is open and in a state where the main-contact-side movable contact 23 is in the input state and the main contact mechanism 2 is closed. In view of this, the region where the electromagnet-unit-side edge 78 mutually overlaps with the depressed portion 77*a* is present in both cases of the main contact mechanism 2 being open and the main contact mechanism 2 being closed, thereby allowing reducing a possibility of the foreign matter invading the inside of the movable plunger housing chamber C regardless of whether the main contact mechanism 2 is open or closed.

Conversely, the electromagnet-unit-side foreign matter invasion prevention mechanism 70 blocks the invasion of the foreign matter F invading the inside of the auxiliary contact mechanism housing chamber B from the inside of the movable plunger housing chamber C passing through the through-hole 8*a* on the upper magnetic yoke 8 and the through-hole 44*d* on the coupling plate 44*c*. Specifically, the electromagnet-unit-side collar 71, the electromagnet-unit-side edge 78, the electromagnet-unit-side depressed portion formation portion 77, and the depressed portion 77*a* block the advance.

With the electromagnetic contactor 1 according to the fifth embodiment as well, the electromagnetic contactor 1 may be laterally installed such that the main contact mechanism housing chamber A, the auxiliary contact mechanism housing chamber B, and the movable plunger housing chamber C face the horizontal direction.

In this case as well, the foreign matter invasion prevention mechanism 60 can prevent the foreign matter from invading the auxiliary contact mechanism housing chamber B from the main contact mechanism housing chamber A via the through-hole 10*a*; and can prevent the foreign matter from invading the main contact mechanism housing chamber A from the auxiliary contact mechanism housing chamber B via the through-hole 10*a*. Especially, the region where the edge 69 mutually overlaps with the depressed portion 68*a* is present. This increases the foreign matter invasion block effect when the electromagnetic contactor 1 is installed laterally such that the main contact mechanism housing chamber A, the auxiliary contact mechanism housing chamber B, and the movable plunger housing chamber C face the horizontal direction.

In this case as well, the electromagnet-unit-side foreign matter invasion prevention mechanism 70 can prevent the foreign matter from invading the movable plunger housing chamber C from the auxiliary contact mechanism housing chamber B via the through-hole 44*d* on the coupling plate 44*c* and the through-hole 8*a* on the upper magnetic yoke 8; and can prevent the foreign matter from invading the auxiliary contact mechanism housing chamber B from the movable plunger housing chamber C via the through-hole 8*a* on the upper magnetic yoke 8 and the through-hole 44*d* on the coupling plate 44*c*. Especially, the region where the electromagnet-unit-side edge 78 mutually overlaps with the depressed portion 77*a* is present. This increases the foreign matter invasion block effect when the electromagnetic contactor 1 is installed laterally such that the main contact mechanism housing chamber A, the auxiliary contact mechanism housing chamber B, and the movable plunger housing chamber C face the horizontal direction.

While the first to the fifth embodiments of the present invention are described above, the present invention is not limited to these embodiments and various modifications and improvements are possible.

For example, the electromagnetic contactors 1 according to the first to the fifth embodiments may omit the electromagnet-unit-side foreign matter invasion prevention mechanism 70.

It is only necessary for the electromagnetic contactors 1 according to the first to the fifth embodiments that the foreign matter invasion prevention mechanism 60 prevents the foreign matter from invading the auxiliary contact mechanism housing chamber B from the main contact mechanism housing chamber A via the through-hole 10*a*; and prevents the foreign matter from invading the main contact mechanism housing chamber A from the auxiliary contact mechanism housing chamber B via the through-hole 10*a*. The configuration is not limited to the configurations described as the examples.

It is only necessary for the electromagnetic contactors 1 according to the first to the fifth embodiments that the electromagnet-unit-side foreign matter invasion prevention mechanism 70 prevents the foreign matter from invading the movable plunger housing chamber C from the auxiliary contact mechanism housing chamber B via the through-hole 44*d* on the coupling plate 44*c* and the through-hole 8*a* on the upper magnetic yoke 8; and prevents the foreign matter from invading the auxiliary contact mechanism housing chamber B from the movable plunger housing chamber C via the through-hole 8*a* on the upper magnetic yoke 8 and the through-hole 44*d* on the coupling plate 44*c*. The configuration is not limited to the configurations described as the examples.

With the electromagnetic contactor 1 according to the first embodiment, while the collar 62 and the electromagnet-unit-side collar 71 are each formed into the circular plate shape, the collar 62 and the electromagnet-unit-side collar 71 may have another shape such as a polygonal plate shape and an oval plate shape.

With the electromagnetic contactor 1 according to the second embodiment, while the collar 62 and the electromagnet-unit-side collar 71 are each formed into the circular plate shape, the collar 62 and the electromagnet-unit-side collar 71 may have another shape such as a polygonal plate shape and an oval plate shape. In this case, the outer edge 63 is not limited to have the circular ring shape, and it is only necessary to have the shape of a closed outer periphery matching the outer shape of the collar 62. The outer periphery of the outer edge 63 may be partially open. The shape of the electromagnet-unit-side outer edge 72 is similar to the shape of the outer edge 63.

Further, with the electromagnetic contactor 1 according to the third embodiment, while the collar 62 and the electromagnet-unit-side collar 71 are each formed into the circular plate shape, the collar 62 and the electromagnet-unit-side collar 71 may have another shape such as a polygonal plate shape and an oval plate shape. The plurality of depressed portions 64 are not limited to have the circular ring shape. The plurality of electromagnet-unit-side depressed portions 73 are also not limited to have the circular ring shape.

With the electromagnetic contactor 1 according to the fourth embodiment, while the collar 62 and the electromagnet-unit-side collar 71 are each formed into the circular plate shape, the collar 62 and the electromagnet-unit-side collar 71 may have another shape such as a polygonal plate shape and an oval plate shape. In this case, the protrusion 66 of the foreign matter invasion prevention auxiliary portion 65 is not limited to have the circular ring shape, and it is only necessary to have the shape of a closed outer periphery matching the outer shape of the collar 62. The outer periphery of the protrusion 66 may be partially open. The plate 67 is shaped so as to match the shape of the protrusion 66. The same applies to the shape of the electromagnet-unit-side protrusion 75 of the electromagnet-unit-side foreign matter invasion prevention auxiliary portion 74 and the shape of the electromagnet-unit-side plate 76.

With the electromagnetic contactor 1 according to the fifth embodiment, while the collar 62 and the electromagnet-unit-side collar 71 are each formed into the circular plate shape, the collar 62 and the electromagnet-unit-side collar 71 may have another shape such as a polygonal plate shape and an oval plate shape. In this case, the edge 69 is not limited to have the circular ring shape, and it is only necessary to have the shape of a closed outer periphery matching the outer shape of the collar 62. The outer periphery of the edge 69 may be partially open. It is only necessary for the depressed portion 68*a* to have the shape with which the edge 69 can enter. The shape of the electromagnet-unit-side edge 78 is similar to the shape of the edge 69. The shape of the depressed portion 77*a* is similar to the shape of the depressed portion 68*a*.

REFERENCE SIGNS LIST

1 electromagnetic contactor,
2 main contact mechanism,
3 electromagnet unit,
4 auxiliary contact mechanism,
5 housing chamber,
8 upper magnetic yoke (magnetic yoke),
8*a* through-hole,
10 partition wall,
21, 22 main-contact-side fixed contact,
23 main-contact-side movable contact,
31 lower magnetic yoke (magnetic yoke),
33 movable plunger,
34 coupling shaft,
41, 42 auxiliary-contact-side fixed contact,
43 auxiliary-contact-side movable contact,
44 auxiliary fixed contact support member,
44*c* coupling plate (electromagnet-unit-side partition wall),
44*d* through-hole,
45 auxiliary movable contact support member,
46 auxiliary movable contact support,
60 foreign matter invasion prevention mechanism,
61 insertion portion,
62 collar,
63 outer edge,
63*a* depressed portion,
64 depressed portion,
65 foreign matter invasion prevention auxiliary portion,
66 protrusion,
67 plate,
68 depressed portion formation portion (partition wall),
68*a* depressed portion,
69 edge,
70 electromagnet-unit-side foreign matter invasion prevention mechanism,
71 electromagnet-unit-side collar,
72 electromagnet-unit-side outer edge,
73 electromagnet-unit-side depressed portion,
74 electromagnet-unit-side foreign matter invasion prevention auxiliary portion,
75 electromagnet-unit-side protrusion,
76 electromagnet-unit-side plate,
77 electromagnet-unit-side depressed portion formation portion (electromagnet-unit-side partition wall),
78 electromagnet-unit-side edge,
A main contact mechanism housing chamber,
B auxiliary contact mechanism housing chamber,
C movable plunger housing chamber

The invention claimed is:

1. The electromagnetic contactor comprising:

a main contact mechanism housing chamber housing a main contact mechanism including a pair of main-contact-side fixed contacts and a main-contact-side movable contact, the main-contact-side movable contact being contactable to/separable from the pair of main-contact-side fixed contacts;

an auxiliary contact mechanism housing chamber housing an auxiliary contact mechanism including a plurality of pairs of auxiliary-contact-side fixed contacts, a plurality of auxiliary-contact-side movable contacts, and an auxiliary movable contact support member, the plurality of auxiliary-contact-side movable contacts being contactable to/separable from the plurality of pairs of auxiliary-contact-side fixed contacts, the auxiliary movable contact support member supporting the auxiliary-contact-side movable contacts; and an electromagnet unit including a movable plunger and a magnetic yoke, the movable plunger being coupled to the main-contact-side movable contact and the auxiliary movable contact support member via a coupling shaft, the magnetic yoke housing the movable plunger, wherein the main contact mechanism housing chamber and the auxiliary contact mechanism housing chamber are partitioned by a partition wall, the partition wall having a through-hole through which the coupling shaft is inserted, and a foreign matter invasion prevention mechanism is provided at a peripheral area of the through-hole, wherein the foreign matter invasion prevention mechanism includes:

an insertion portion disposed at the auxiliary movable contact support member, the insertion portion entering into the through-hole on the partition wall; and a collar projecting outward perpendicular to a direction in which the coupling shaft extends from the insertion portion in the auxiliary contact mechanism housing chamber.

2. The electromagnetic contactor according to claim 1, wherein the foreign matter invasion prevention mechanism includes an outer edge projecting from an outer peripheral edge of the collar to the partition wall in the direction in which the coupling shaft extends, and between the outer edge and the insertion portion, a depressed portion is formed.

3. The electromagnetic contactor according to claim 1, wherein the foreign matter invasion prevention mechanism includes a plurality of depressed portions disposed at a surface of the collar on the partition wall side.

4. The electromagnetic contactor according to claim 1, wherein the foreign matter invasion prevention mechanism includes a foreign matter invasion prevention auxiliary portion formed of a protrusion and a plate to cover an outside of the collar, the protrusion extending from the partition wall in the extension direction of the coupling shaft, the plate extending from a distal end of the protrusion to the through-hole parallel to the partition wall.

5. The electromagnetic contactor according to claim 1, wherein the foreign matter invasion prevention mechanism includes the partition wall having a depressed portion at the peripheral area of the through-hole and an edge, the edge extending from an outer peripheral edge of the collar to the depressed portion on the partition wall in the extension direction of the coupling shaft.

6. The electromagnetic contactor comprising:

a main contact mechanism housing chamber housing a main contact mechanism including a pair of main-contact-side fixed contacts and a main-contact-side movable contact, the main-contact-side movable contact being contactable to/separable from the pair of main-contact-side fixed contacts;

an auxiliary contact mechanism housing chamber housing an auxiliary contact mechanism including a plurality of pairs of auxiliary-contact-side fixed contacts, a plurality of auxiliary-contact-side movable contacts, and an auxiliary movable contact support member, the plurality of auxiliary-contact-side movable contacts being contactable to/separable from the plurality of pairs of auxiliary-contact-side fixed contacts, the auxiliary movable contact support member supporting the auxiliary-contact-side movable contacts; and an electromagnet unit including a movable plunger and a magnetic yoke, the movable plunger being coupled to the main-contact-side movable contact and the auxiliary movable contact support member via a coupling shaft, the magnetic yoke housing the movable plunger, wherein the main contact mechanism housing chamber and the auxiliary contact mechanism housing chamber are partitioned by a partition wall, the partition wall having a through-hole through which the coupling shaft is inserted, and a foreign matter invasion prevention mechanism is provided at a peripheral area of the through-hole, and the electromagnetic contactor further comprising an electromagnet-unit-side partition wall having a through-hole between the auxiliary contact mechanism and the electromagnet unit, the coupling shaft being inserted through the through-hole; and an electromagnet-unit-side foreign matter invasion prevention mechanism at a peripheral area of the electromagnet-unit-side partition wall.

7. The electromagnetic contactor according to claim 6, wherein the foreign matter invasion prevention mechanism includes:

an insertion portion disposed at the auxiliary movable contact support member, the insertion portion entering into the through-hole on the partition wall; and a collar projecting outward perpendicular to a direction in which the coupling shaft extends from the insertion portion in the auxiliary contact mechanism housing chamber.

8. The electromagnetic contactor according to claim 7, wherein the foreign matter invasion prevention mechanism includes an outer edge projecting from an outer peripheral edge of the collar to the partition wall in the direction in which the coupling shaft extends, and between the outer edge and the insertion portion, a depressed portion is formed.

9. The electromagnetic contactor according to claim 7, wherein the foreign matter invasion prevention mechanism includes a plurality of depressed portions disposed at a surface of the collar on the partition wall side.

10. The electromagnetic contactor according to claim 7, wherein the foreign matter invasion prevention mechanism includes a foreign matter invasion prevention auxiliary portion formed of a protrusion and a plate to cover an outside of the collar, the protrusion extending from the partition wall in the extension direction of the coupling shaft, the plate extending from a distal end of the protrusion to the through-hole parallel to the partition wall.

11. The electromagnetic contactor according to claim 7, wherein the foreign matter invasion prevention mechanism includes the partition wall having a depressed portion at the peripheral area of the through-hole and an edge, the edge extending from an outer peripheral edge of the collar to the depressed portion on the partition wall in the extension direction of the coupling shaft.

12. The electromagnetic contactor according to claim 6, wherein the electromagnet-unit-side foreign matter invasion prevention mechanism includes an electromagnet-unit-side collar disposed at the auxiliary movable contact support member, the electromagnet-unit-side collar projecting outward perpendicular to the direction that the coupling shaft extends in the auxiliary contact mechanism housing chamber.

13. The electromagnetic contactor according to claim 6, wherein the electromagnet-unit-side partition wall is constituted of a coupling plate, the coupling plate being placed on the magnetic yoke, the coupling plate coupling an auxiliary fixed contact support member supporting the auxiliary-contact-side fixed contacts.

14. The electromagnetic contactor according to claim 12, wherein the electromagnet-unit-side foreign matter invasion prevention mechanism includes an electromagnet-unit-side outer edge, the electromagnet-unit-side outer edge projecting from an outer peripheral edge of the electromagnet-unit-side collar to the electromagnet-unit-side partition wall in the direction in which the coupling shaft extends.

15. The electromagnetic contactor according to claim 12, wherein the electromagnet-unit-side foreign matter invasion prevention mechanism includes a plurality of electromagnet-unit-side depressed portions, the plurality of electromagnet-unit-side depressed portions being disposed at a surface of the electromagnet-unit-side collar on the electromagnet-unit-side partition wall side.

16. The electromagnetic contactor according to claim 12, wherein the electromagnet-unit-side foreign matter invasion prevention mechanism includes an electromagnet-unit-side foreign matter invasion prevention auxiliary portion formed of an electromagnet-unit-side protrusion and an electromagnet-unit-side plate to cover an outside of the electromagnet-unit-side collar, the electromagnet-unit-side protrusion extending from the electromagnet-unit-side partition wall in the extension direction of the coupling shaft, the electromagnet-unit-side plate extending from a distal end of the electromagnet-unit-side protrusion to the through-hole on the electromagnet-unit-side partition wall parallel to the electromagnet-unit-side partition wall.

17. The electromagnetic contactor according to claim 12, wherein the electromagnet-unit-side foreign matter invasion prevention mechanism includes the electromagnet-unit-side partition wall having a depressed portion at a peripheral area of the through-hole on the electromagnet-unit-side partition wall and an electromagnet-unit-side edge, the electromagnet-unit-side edge extending from an outer peripheral edge of the electromagnet-unit-side collar to the depressed portion on the electromagnet-unit-side partition wall in the extension direction of the coupling shaft.

* * * * *